US008780144B2

(12) United States Patent
Kikuta

(10) Patent No.: US 8,780,144 B2
(45) Date of Patent: Jul. 15, 2014

(54) IMAGE PROCESSING APPARATUS, DISPLAY SYSTEM, ELECTRONIC APPARATUS, AND METHOD OF PROCESSING IMAGE

(75) Inventor: Kazuto Kikuta, Hadnioji (JP)

(73) Assignee: Seiko Epson Corporation, Tokyo (JP)

( * ) Notice: Subject to any disclaimer, the term of this patent is extended or adjusted under 35 U.S.C. 154(b) by 382 days.

(21) Appl. No.: 12/835,824

(22) Filed: Jul. 14, 2010

(65) Prior Publication Data

US 2011/0043551 A1 Feb. 24, 2011

(30) Foreign Application Priority Data

Aug. 18, 2009 (JP) ..... 2009-188945

(51) Int. Cl.
*G09G 5/10* (2006.01)
*G09G 3/32* (2006.01)

(52) U.S. Cl.
CPC ..... *G09G 3/3233* (2013.01); *G09G 2320/046* (2013.01)
USPC ..... 345/690; 345/691

(58) Field of Classification Search
USPC ..... 345/691
See application file for complete search history.

(56) References Cited

U.S. PATENT DOCUMENTS 6,292,591 B1 9/2001 Kondo
7,088,052 B2 8/2006 Kimura
7,227,519 B1 6/2007 Kawase et al.
7,414,795 B2 * 8/2008 Cok ..... 359/649
7,859,492 B2 12/2010 Kohno
2001/0024186 A1 9/2001 Kane et al.
2002/0030647 A1 3/2002 Hack et al.
2002/0033783 A1 3/2002 Koyama
2003/0011314 A1 1/2003 Numao
2003/0058229 A1 * 3/2003 Kawabe et al. ..... 345/204
2003/0063053 A1 4/2003 Yamazaki et al.
2003/0090446 A1 5/2003 Tagawa et al.
2003/0122813 A1 7/2003 Ishizuki et al.
2004/0150592 A1 8/2004 Mizukoshi et al.

(Continued)

FOREIGN PATENT DOCUMENTS

JP A-2001-142437 5/2001
JP A-2001-350442 12/2001

(Continued)

OTHER PUBLICATIONS

U.S. Appl. No. 13/084,186, filed Apr. 11, 2011 in the name of Kikuta.

(Continued)

*Primary Examiner* — Dorothy Harris
(74) *Attorney, Agent, or Firm* — Oliff PLC

(57) ABSTRACT

An image processing apparatus that performs display control of an image displayed on a display unit, includes a first control circuit for controlling image data of a frame in question or a display timing control signal corresponding to the image data so as to display each pixel forming the image with different brightness at given intervals, and a second control circuit for controlling the image data or the display timing control signal by different control from that by the first control circuit so as to display each pixel forming the image with different brightness at given intervals, wherein the first control circuit and the second control circuit control image data of an identical frame or a display timing control signal corresponding to the image data.

10 Claims, 23 Drawing Sheets

(56) References Cited

U.S. PATENT DOCUMENTS

| | | | | |
|---|---|---|---|---|
| 2004/0222954 | A1 | 11/2004 | Lueder | |
| 2005/0110420 | A1 | 5/2005 | Arnold et al. | |
| 2005/0110728 | A1 | 5/2005 | Cok | |
| 2005/0156831 | A1 | 7/2005 | Yamazaki et al. | |
| 2005/0195178 | A1 | 9/2005 | Jo et al. | |
| 2005/0253785 | A1* | 11/2005 | Miyasaka et al. | 345/63 |
| 2006/0001613 | A1 | 1/2006 | Routley et al. | |
| 2007/0080905 | A1 | 4/2007 | Takahara | |
| 2007/0091042 | A1 | 4/2007 | Chung et al. | |
| 2007/0127569 | A1* | 6/2007 | Hatalkar | 375/240.12 |
| 2007/0290947 | A1 | 12/2007 | Cok | |
| 2008/0024526 | A1 | 1/2008 | Ko et al. | |
| 2008/0036703 | A1 | 2/2008 | Wang et al. | |
| 2008/0048951 | A1 | 2/2008 | Naugler et al. | |
| 2008/0111812 | A1 | 5/2008 | Shirasaki et al. | |
| 2008/0111886 | A1* | 5/2008 | Bai | 348/173 |
| 2008/0143729 | A1 | 6/2008 | Wyatt et al. | |
| 2008/0204378 | A1 | 8/2008 | Park et al. | |
| 2008/0284702 | A1 | 11/2008 | Shidara et al. | |
| 2009/0051637 | A1* | 2/2009 | Chen et al. | 345/88 |
| 2010/0123649 | A1 | 5/2010 | Hamer et al. | |
| 2011/0043551 | A1 | 2/2011 | Kikuta | |
| 2011/0050744 | A1 | 3/2011 | Kikuta | |

FOREIGN PATENT DOCUMENTS

| | | |
|---|---|---|
| JP | A-2003-280578 | 10/2003 |
| JP | A-2004-184900 | 7/2004 |
| JP | A-2005-055800 | 3/2005 |
| JP | A-2005-062485 | 3/2005 |
| JP | A-2005-530203 | 10/2005 |
| JP | A-2007-065015 | 3/2007 |
| JP | A 2007-304318 | 11/2007 |
| JP | A-2007-322460 | 12/2007 |
| JP | A-2007-333997 | 12/2007 |
| JP | A 2008-197626 | 8/2008 |
| JP | A-2009-086673 | 4/2009 |
| JP | A-2011-028149 | 2/2011 |
| JP | A-2011-039042 | 2/2011 |
| JP | A-2011-048043 | 3/2011 |
| WO | WO 03/107318 A1 | 12/2003 |

OTHER PUBLICATIONS

U.S. Appl. No. 13/084,083, filed Apr. 11, 2011 in the name of Kikuta et al.

Oct. 3, 2013 Office Action issued in U.S. Appl. No. 13/084,186.

Sep. 30, 2013 Office Action issued in U.S. Appl. No. 12/835,070.

U.S. Appl. No. 12/835,070, filed Jul. 13, 2010 in the name of Kikuta.

Apr. 15, 2013 Office Action issued in U.S. Appl. No. 13/084,186.

Dec. 26, 2013 Office Action issued in U.S. Appl. No. 13/084,083.

Jul. 23, 2013 Office Action issued in U.S. Appl. No. 13/084,083.

May 16, 2013 Office Action issued in U.S. Appl. No. 12/835,070.

May 2, 2014 Office Action issued in U.S. Appl. No. 13/084,083.

* cited by examiner

| | 0 | 1 | 2 | 3 | 4 | 5 | ····· |
|---|---|---|---|---|---|---|---|
| CD | 240 | 255 | 1 | 0 | 3 | 127 | ····· |
| PD | 240 | 255 | 1 | 0 | 3 | 127 | ····· |
| | ↓ | ↓ | ↓ | ↓ | ↓ | ↓ | ····· |
| | OK | OK | OK | OK | OK | OK | ····· |

| | 0 | 1 | 2 | 3 | 4 | 5 | ····· |
|---|---|---|---|---|---|---|---|
| CD | 255 | 255 | 0 | 0 | 1 | 3 | ····· |
| PD | 255 | 254 | 0 | 0 | 1 | 3 | ····· |
| | ↓ | ↓ | ↓ | ↓ | ↓ | ↓ | ····· |
| | OK | NG | OK | OK | OK | OK | ····· |

| mode[1:0] | m[3] | m[2] | m[1] | m[0] |
|---|---|---|---|---|
| 2´b00 | 1 | 1 | 1 | 0 |
| 2´b01 | 1 | 1 | 0 | 0 |
| 2´b10 | 1 | 0 | 0 | 0 |
| 2´b11 | 0 | 0 | 0 | 0 |

FIG.16

IMAGE PROCESSING APPARATUS, DISPLAY SYSTEM, ELECTRONIC APPARATUS, AND METHOD OF PROCESSING IMAGE

This application claims priority based on Japanese Patent Application No. 2009-188945, filed on Aug. 18, 2009, which is incorporated in this specification.

BACKGROUND

1. Technical Field

An aspect of the present invention relates to an image processing apparatus, a display system, an electronic apparatus, a method of processing an image.

2. Background Art

In recent years, an LCD (Liquid Crystal Display) panel using a liquid crystal element as a display element, and a display panel (a display unit) using an organic light emitting diode (hereinafter abbreviated as OLED) (in a broad sense, a light emitting element) as a display element have become widely available. In particular, OLEDs have a fast response speed and can increase a contrast ratio. Therefore, a display panel with OLEDs arranged in a matrix manner provides a wide viewing angle, and displays a high quality image.

However, even a display panel using OLEDs poses the following problem; when an identical light emitting element remains on with identical brightness over a long period of time, just as in the case where a still image is displayed over a long period of time, brightness degrades due to deterioration, and a so-called sticking phenomenon occurs, thus causing degradation of image quality.

A technique of preventing a sticking phenomenon using such OLEDs is disclosed in JP-A-2007-304318 and JP-A-2008-197626, for example, JP-A-2007-304318 discloses an organic light emitting display unit that controls gradation of an image according to a current value applied as an image signal or an application time of a constant current and moves a display position by a predetermined distance at predetermined time intervals. In addition, JP-A-2008-197626 discloses a technique of decreasing a visual sign in switching a refresh rate of a display.

SUMMARY

However, techniques disclosed in Patent Document 1 and Patent Document 2 perform such control as described above irrespective of the type of an input image. Therefore, in some display panels or display images, a sticking prevention phenomenon may not be significantly alleviated.

The present invention is made in view of the above-described technical problem. According to some embodiments of the present invention, there can be provided an image processing apparatus, a display system, an electronic apparatus, a method of processing an image and the like, capable of alleviating a so-called sticking phenomenon without depending upon a display unit for displaying images or images.

Means for Solving the Problems (1) According to an aspect of the present invention, an image processing apparatus that performs display control of an image displayed on a display unit, includes a first control circuit for controlling image data of a frame in question or a display timing control signal corresponding to the image data so as to display each pixel forming the image with different brightness at given intervals, and a second control circuit for controlling the image data or the display timing control signal by different control from that by the first control circuit so as to display each pixel forming the image with different brightness at given intervals, wherein the first control circuit and the second control circuit control image data of an identical frame or a display timing control signal corresponding to the image data.

According to the present aspect, more than one sticking prevention control is performed on image data of an identical frame or a display timing control signal corresponding to the image data, thus alleviating an adverse effect of a sticking phenomenon depending upon a display unit or a display image, and minimizing the sticking phenomenon without depending upon the display unit or the display image.

(2) An image processing apparatus according to another aspect of the present invention includes an interval register set with control data corresponding to an interval time between first control start timing by the first control circuit and second control start timing by the second control circuit, wherein after the control of the image data or the display timing control signal is started by the first control circuit, and the interval time set in the interval register has elapsed, the first control circuit and the second control circuit control image data of an identical frame or a display timing control signal corresponding to the image data.

According to the present aspect, the types of sticking prevention control are increased after an interval time has elapsed, thus further alleviating an adverse effect of a so-called sticking phenomenon.

(3) An image processing apparatus according to another aspect of the present invention includes a still image continuous detection part for detecting whether or not frames for which images to be displayed are still images are continuous, wherein the first control circuit and the second control circuit start control of the image data or the display timing control signal, provided that the still image continuous detection part detects that frames of still images are continuous.

According to the present aspect, in addition to the above advantages, whether or not frames of still images are continuous is detected, and when it is detected that the frames of still images are continuous, image data or a display timing control signal corresponding to the image data is controlled, thus alleviating a so-called sticking phenomenon with low power consumption and with high efficiency without causing degradation of image quality.

(4) In an image processing apparatus according to another aspect of the present invention, the still image continuous detection part detects whether or not frames of still images are continuous, based on a comparison result between a pixel value of each pixel forming an image of a frame in question and a pixel value of each pixel forming an image of an immediately preceding frame.

According to the present aspect, in addition to the above advantages, whether or not frames of still images are continuous can be detected with a simple configuration.

(5) An image processing apparatus according to another aspect of the present invention includes a detection condition designation register for designating the number of blocks matching between the frame in question and the immediately preceding frame in each of a plurality of blocks into which one screen is divided, wherein the still image continuous detection part performs a comparison between a pixel value of each pixel forming an image of a frame in question and a pixel value of each pixel forming an image of an immediately preceding frame, for each block, and detects whether or not frames of still images are continuous, based on the number of blocks designated by the detection condition designation register.

According to the present aspect, in addition to the above advantages, degradation of image quality due to flicker or the like, which may be generated by sticking prevention control, can be suppressed, and precision in which an image is detected as a still image can be controlled according to the number of blocks, thus easily controlling the detection precision.

(6) An image processing apparatus according to another aspect of the present invention includes a threshold setting register for designating the number of matching or mismatching pixels in the block, wherein the still image continuous detection part determines that the block matches if the number of pixels matching in the block is equal to or more than the number of pixels set in the threshold setting register, or if the number of pixels mismatching in the block is equal to or less than the number of pixels set in the threshold setting register.

According to the present aspect, in addition to the above advantages, even when still images having allowable noise are continuous, without exact detection of the continuity of still images, an event can be avoided where the images are determined to be moving images.

(7) In an image processing apparatus according to another aspect of the present invention, the first control circuit and the second control circuit output the image data or the display timing control signal so as to display each pixel forming the image with different brightness at given intervals in at least one mode among a first mode of shifting an original display image by an amount corresponding to one dot after a first interval time has elapsed, a second mode of switching between interlace scanning and progressive scanning each time a second interval time has elapsed, a third mode of lowering a frame rate for each dot and a fourth mode of thinning out an image display for each given frame.

According to the present aspect, in addition to the above advantages, a sticking prevention phenomenon depending upon a display image or a display panel can be further alleviated.

(8) In an image processing apparatus according to another aspect of the present invention, the first mode sequentially repeats, at every lapse of a given period of time, a first shift of shifting an original display image by an amount corresponding to one scanning line in a first vertical scanning direction of a screen of the display unit, a second shift of shifting an original display image by an amount corresponding to one pixel in a first horizontal scanning direction of the screen of the display unit, a third shift of shifting an original display image by an amount corresponding to one scanning line in an opposite direction to the first vertical scanning direction of the screen of the display unit, and a fourth shift of shifting an original display image by an amount corresponding to one dot in an opposite direction to the first horizontal scanning direction of the screen of the display unit.

According to the present aspect, a sticking prevention phenomenon depending upon a display image or a display panel can be further alleviated.

(9) According to another aspect of the present invention, a display system includes a display panel having a plurality of row signal lines, a plurality of column signal lines crossing the plurality of row signal lines, and a plurality of light emitting elements, which are identified by any of the plurality of row signal lines and any of the plurality of column signal lines, and emit light with brightness according to a driving current; a row driver for driving the plurality of row signal lines; a column driver for driving the plurality of column signal lines; and the image processing apparatus of any of the above for outputting the display control signal to the row driver and the column driver and outputting the image data to the column driver.

According to the present aspect, a display unit can be provided, which is capable of alleviating a so-called sticking phenomenon without depending upon a display unit displaying images or images.

(10) According to another aspect of the present invention, an electronic apparatus includes the image processing apparatus of any of the above.

According to the present aspect, an electronic apparatus can be provided, to which an image processing apparatus is applied, capable of alleviating a so-called sticking phenomenon without depending upon a display unit displaying images or images.

(11) According to an aspect of the present invention, a method of processing an image that performs display control of an image displayed on a display unit, includes a first control step of controlling image data of a frame in question or a display timing control signal based on the image data so as to display each pixel forming the image with different brightness at given intervals, and a second control step of controlling the image data or the display timing control signal by different control from that by the first control step so as to display each pixel forming the image with different brightness at given intervals, wherein the first control step and the second control step control image data of an identical frame or a display timing control signal based on the image data.

According to the present aspect, more than one sticking prevention control is performed on image data of an identical frame or a display timing control signal corresponding to the image data, thus alleviating an adverse effect of a sticking phenomenon depending upon a display unit or a display image, and minimizing the sticking phenomenon without depending upon the display unit or the display image.

(12) A method of processing an image according to another aspect of the present invention includes an interval setting step of setting an interval between first control start timing in the first control step and second control start timing in the second control step, wherein after control of the image data or the display timing control signal is started in the first control step, and an interval set in the interval setting step has elapsed, the first control step and the second control step control image data of an identical frame or a display timing control signal based on the image data.

According to the present aspect, the types of sticking prevention control are increased after an interval time has elapsed, thus further alleviating an adverse effect of a so-called sticking phenomenon.

(13) A method of processing an image according to another aspect of the present invention includes a still image continuous detection step of detecting whether or not frames for which images to be displayed are still images are continuous, wherein the first control step and the second control step start control of the image data or the display timing control signal, provided that the still image continuous detection step detects that frames of still images are continuous.

According to the present aspect, in addition to the above advantages, whether or not frames of still images are continuous is detected, and when it is detected that the frames of still images are continuous, image data or a display timing control signal corresponding to the image data is controlled, thus alleviating a so-called sticking phenomenon with low power consumption and with high efficiency without causing degradation of image quality.

(14) In a method of processing an image according to another aspect of the present invention, the detection condition designation step designates the number of matching or mismatching pixels in the block, and the still image continuous detection step determines that the block matches when the number of pixels matching in the block is equal to or more than the number of pixels matching in a block designated in the detection condition designation step, or when the number of pixels mismatching in the block is equal to or less than the number of pixels mismatching in a block designated in the detection condition designation step.

According to the present aspect, in addition to the above advantages, even when still images having allowable noise are continuous, without exact detection of the continuity of still images, an event can be avoided where the images are determined to be moving images.

BRIEF DESCRIPTION OF THE DRAWINGS

FIG. 16 is an explanatory diagram of an operation of a mode decoder in FIG. 13;

DESCRIPTION OF EXEMPLARY EMBODIMENTS

An embodiment of the present invention will now be described in detail with reference to the drawings. The embodiment described below does not improperly limit any scope of the present invention set forth in the claims. Additionally, not all of the constituents described below are essential for solving problems of the present invention.

Figure 1:
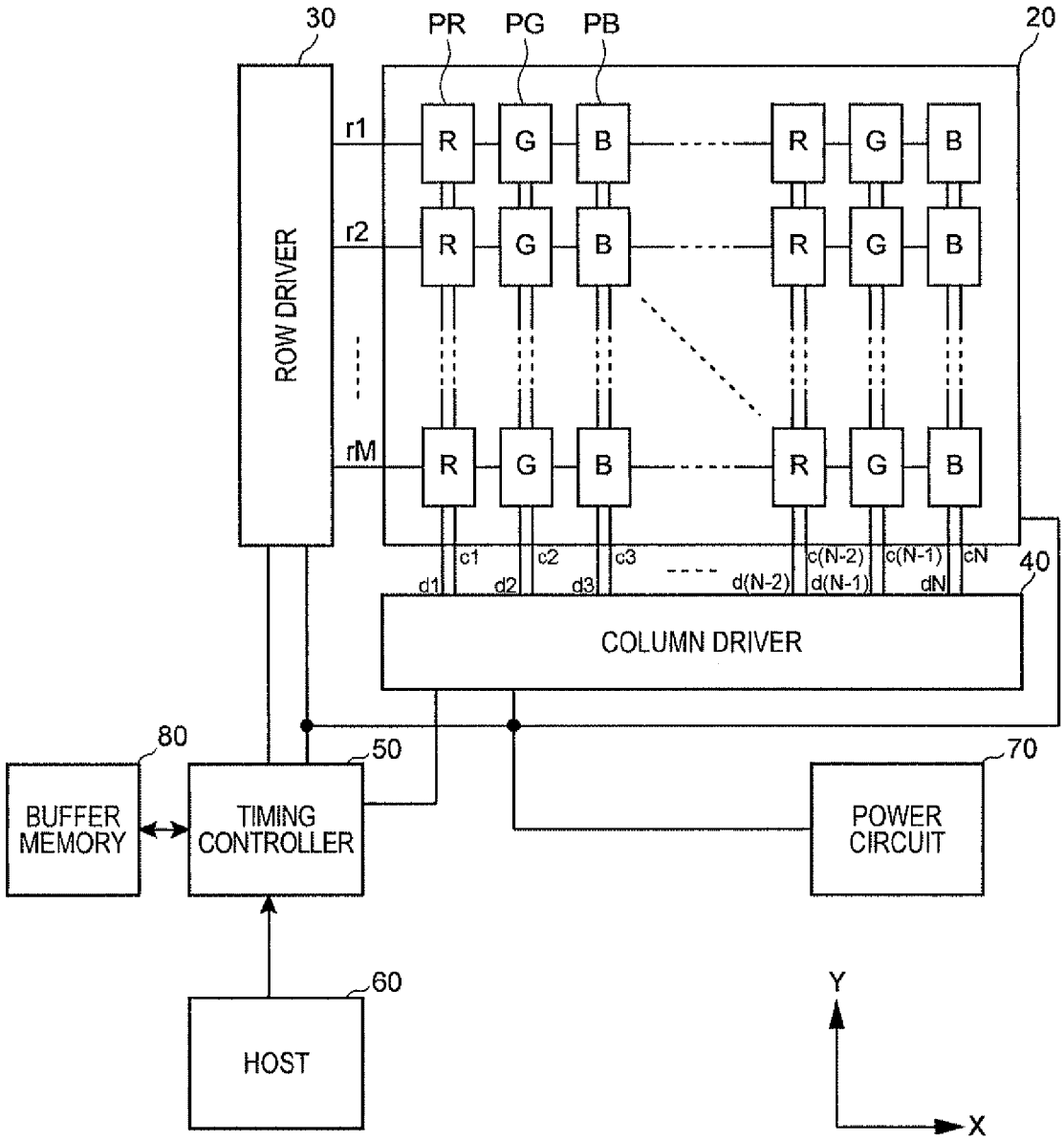
FIG. 1 is a block diagram of configuration example of a display system according to the present embodiment.

FIG. 1 illustrates a block diagram of a configuration example of a display system according to an embodiment of the present invention. The display system has a display panel (a light emitting panel) using OLEDs, which are light emitting elements each serving as a display element. Each of the OLEDs is driven by a row driver and a column driver based on a display timing control signal generated by a timing controller.

More specifically, a display system 10 includes a display panel 20, a row driver 30, a column driver 40, a timing controller 50 (in a broad sense, an image processing circuit or an image processing apparatus), a host 60 and a power circuit 70. In the display panel 20, a plurality of data signal lines d1-dN (N: an integer of 2 or more) and a plurality of column signal lines c1-cN extending in Y direction are arranged in X direction, and a plurality of row signal lines r1-rM (M: an integer of 2 or more) extending in X direction are arranged in Y direction to cross the respective column signal lines and the respective data signal lines. At an intersection position between each column signal line (more specifically, each column signal line and each data signal line) and each row signal line, a pixel circuit is formed, and on the display panel 20, the plurality of pixel circuits are arranged in a matrix manner.

As shown in FIG. 1, one dot is composed of a pixel circuit PR of an R component, a pixel circuit PG of a G component and a pixel circuit PB of a B component adjacent to each other in X direction. The pixel circuit PR of the R component has an OLED which emits a red color light, the pixel circuit PG of the G component has an OLEO which emits a green color light, and the pixel circuit PB of the B component has an OLIJE which emits a blue color light.

The row driver 30 is connected to the row signal lines r1-rM of the display panel 20. The row driver 30 sequentially selects the row signal lines r1-rM of the display panel 20, for example, within one vertical scanning period, and outputs a selected pulse within a selected period of each row signal line.

The column driver 40 is connected to the data signal lines d1-dN and the column signal lines c1-cN of the display panel 20. The column driver 40 applies a given power supply voltage to the column signal lines c1-cN, and every horizontal scanning period, for example, applies a gradation voltage corresponding to image data for one line to each of the data signal lines. Thus, a gradation voltage corresponding to image data is applied to the pixel circuit at a $k^{th}$ column ($1 \leq k \leq N$, k: an integer) of a $j^{th}$ row ($1 \leq j \leq M$, j: an integer) within a horizontal scanning period at which the $j^{th}$ row is selected.

Figure 2:
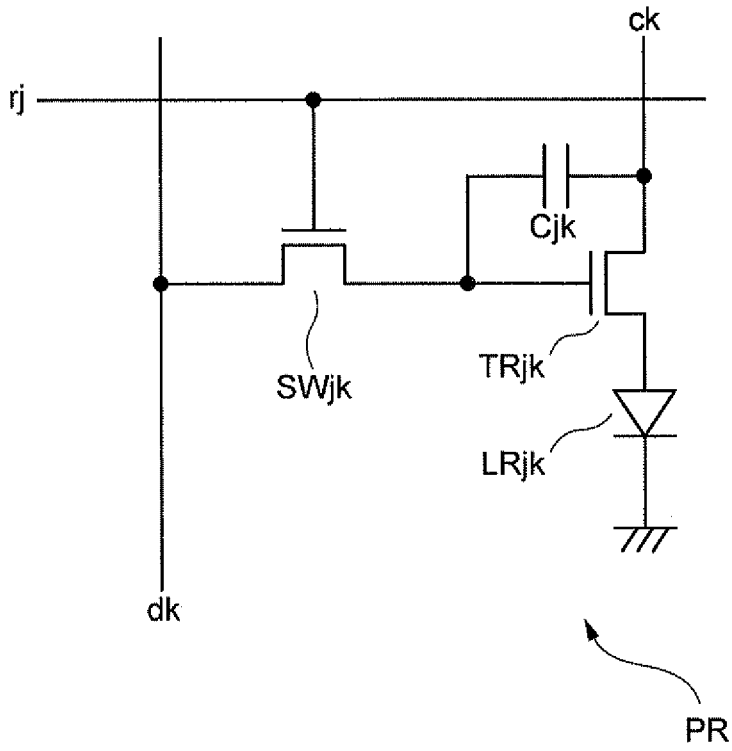
FIG. 2 is a circuit diagram of a configuration example of a pixel circuit according to the present embodiment.

FIG. 2 illustrates a circuit diagram of a configuration example of the pixel circuit PR according to the present embodiment. FIG. 2 shows a configuration example of an electrical equivalent circuit of the pixel circuit PR. The pixel circuit PG and the pixel circuit PB forming one pixel together with the pixel circuit PR have the same configuration as in FIG. 2, respectively. A pixel circuit forming another pixel of the display panel 20 in FIG. 1 has also the same configuration as in FIG. 2.

The pixel circuit PR in FIG. 2 is formed at an intersection position between the row signal line rj and the column signal line ck. The pixel circuit PR includes a drive transistor TRjk, a switch transistor SWjk, a capacitor Cjk and a light emitting element LRjk which emits a red color light. A gate of the switch transistor SWjk is connected with the row signal line rj, a source of the switch transistor SWjk is connected with a data signal line dk, and a drain of the switch transistor SWjk is connected with a gate of the drive transistor TRjk. A source of the drive transistor TRjk is connected with an anode of the light emitting element LRjk and a drain of the drive transistor TRjk is connected with the column signal line ck. A cathode of the light emitting element LRjk is grounded. The gate of the drive transistor TRjk is connected with one end of the capacitor Cjk and the drain of the drive transistor TRjk is connected with the other end of the capacitor Cjk.

With such a configuration, when a selected pulse is applied to the row signal line rj, the switch transistor SWjk is brought into a conduction state, and the voltage corresponding to image data applied to the data signal line dk is applied to the gate of the drive transistor TRjk. At this time, when a given power supply voltage is applied to the column signal line ck, the drive transistor TRjk is brought into a conduction state, and a drive current runs through the light emitting element LRjk. At this time, the light emitting element LRjk emits a red color light.

Figure 3:
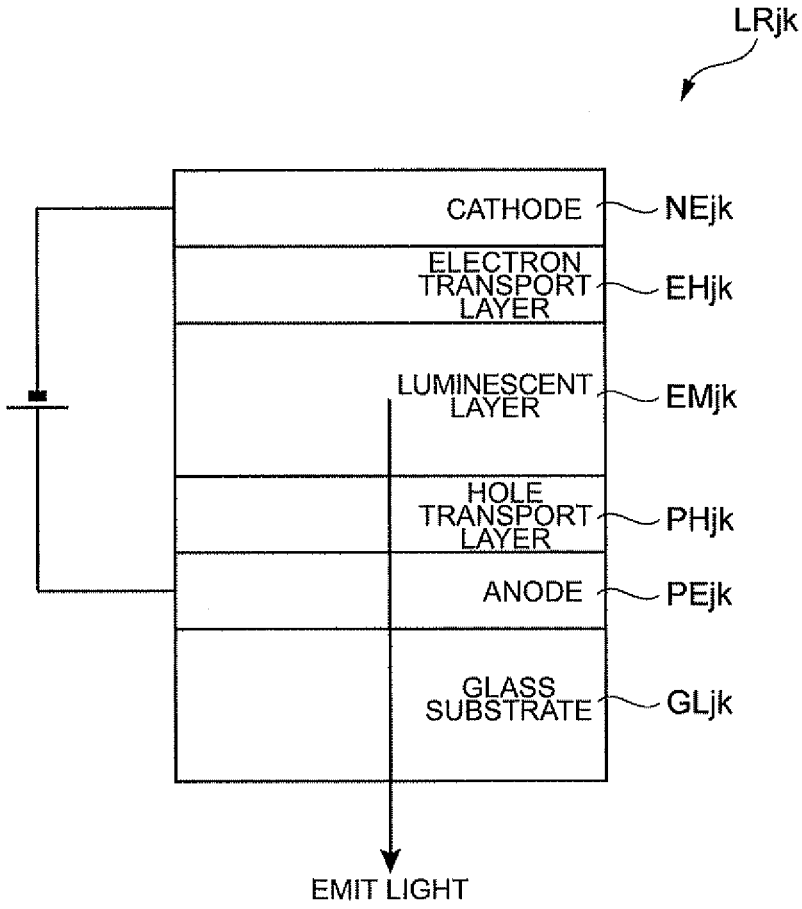
FIG. 3 is an explanatory diagram of an OLED according to the present embodiment.

FIG. 3 schematically shows a fundamental configuration example of the light emitting element LRjk in FIG. 2.

In the light emitting element LRjk, a transparent electrode (for example, ITO (Indium Thin Oxide)) serving as an anode PEjk is formed on a glass substrate GLjk. Above the anode PEjk, a cathode NEjk is formed. Between the anode PEjk and the cathode NEjk, an organic layer including a luminescent layer and the like is formed. The organic layer has a hole transport layer PHjk formed on the top face of the anode PEjk, a luminescent layer EMjk formed on the top face of the hole transport layer PHjk, and an electron transport layer EHjk formed between the luminescent layer EMjk and the cathode NEjk.

For example, when a selected pulse is applied to the row signal line rj to generate a drain current at the drive transistor TRjk according to an applied voltage of the data signal line dk, a potential difference between the anode PEjk and the cathode NEjk is given in FIG. 3. When the potential difference between the anode PEjk and the cathode NEjk is given, a hole from the anode PEjk and an electron from the cathode NEjk combine with each other again in the luminescent layer EMjk. Molecules of the luminescent layer EMjk are excited by the energy generated at this time, and the energy discharged when the molecules return to a ground state thereof becomes a light. The light runs through the anode PEjk and the glass substrate GLjk formed from a transparent electrode.

As shown in FIG. 1, the timing controller 50 supplies a display timing control signal to the row driver 30 and the column driver 40, and supplies image data corresponding to a display image to the column driver 40. In the present embodiment, the timing controller 50 combines a plurality of types of sticking prevention control capable of independently controlling an image for one frame to perform control on the image of an identical frame, allowing image data or a display timing control signal to be output so that each pixel forming the image is displayed with different brightness at given intervals. This allows for alleviation of an adverse effect of a sticking phenomenon depending upon the display panel 20 and the display image, and minimization of the sticking phenomenon without depending upon the display panel 20 and the display image.

Further, the timing controller 50 is connected with a buffer memory 80, which temporarily stores image data for one frame from the host 60, so that whether or not still images are continuous is detected, and a plurality of types of sticking prevention control are started, provided that the still images are continuous. Note that, without the buffer memory 80, a memory having the same function as the buffer memory 80 may be included in the timing controller 50.

Such a timing controller 50 allows the row driver 30 and the column driver 40 to supply a drive current corresponding to image data to the light emitting element, which forms a pixel connected to the row signal line sequentially selected within one vertical scanning period. The image data supplied to the column driver 40, or the display timing control signal supplied to the row driver 30 and the column driver 40 are controlled so that each pixel of the display panel 20 does not continuously remain on for a predetermined period of time with the same brightness.

The host 60 generates image data corresponding to a display image, and sets control data to various types of control registers in the timing controller 50 to perform display control for the display panel 20 by the row driver 30 and the column driver 40.

The power circuit 70 generates a plurality of types of power supply voltages, and supplies a power supply voltage to each of the display panel 20, the row driver 30, the column driver 40 and the timing controller 50.

Figure 4:
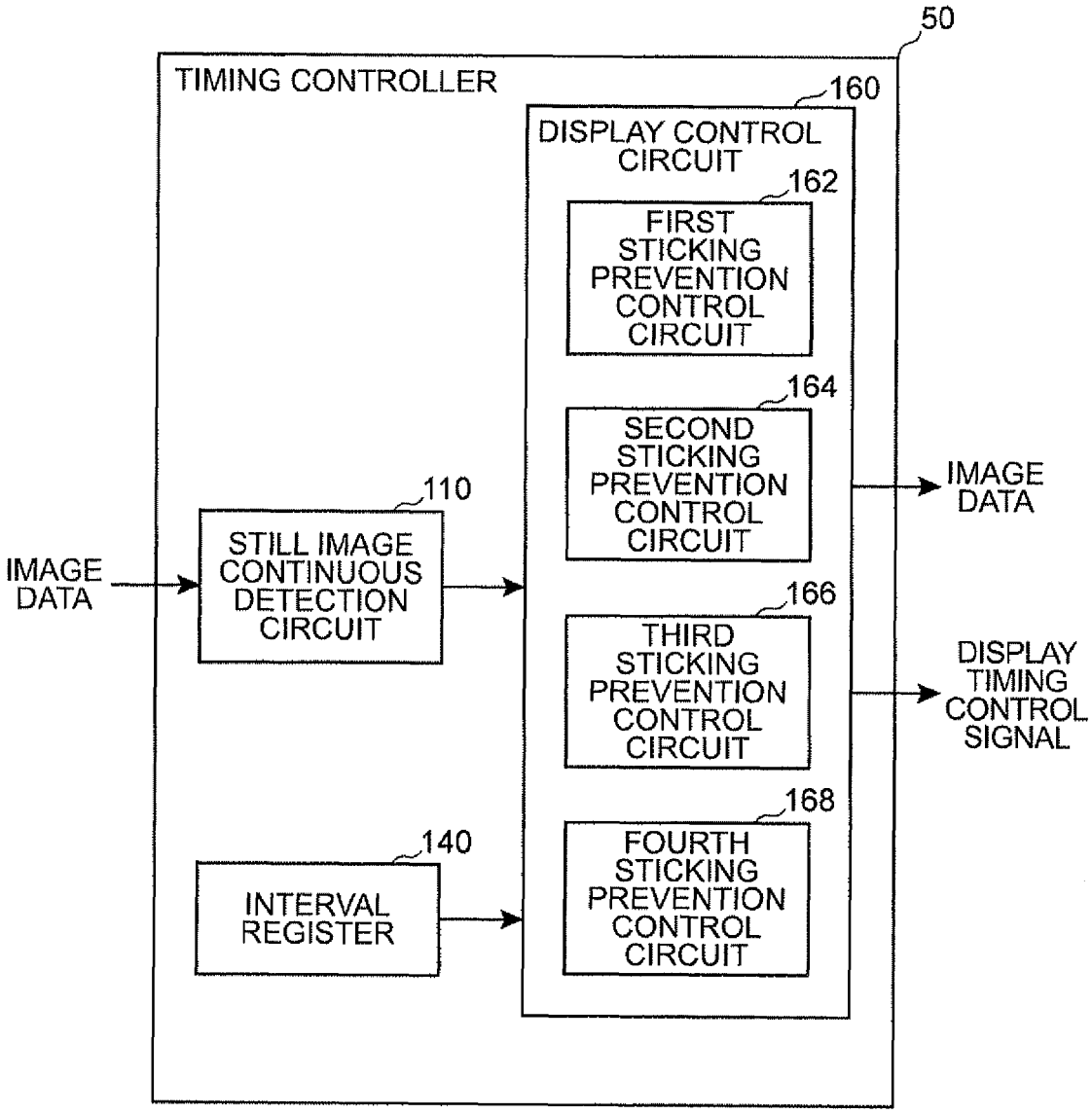
FIG. 4 is a block diagram outlining a configuration of a timing controller in FIG. 1.

FIG. 4 illustrates a block diagram outlining a configuration of the timing controller 50 in FIG. 1. Although FIG. 4 shows a configuration in which the timing controller 50 includes four types of sticking prevention control circuits, the timing controller 50 may include at least two types of sticking prevention control circuits.

Figure 5:
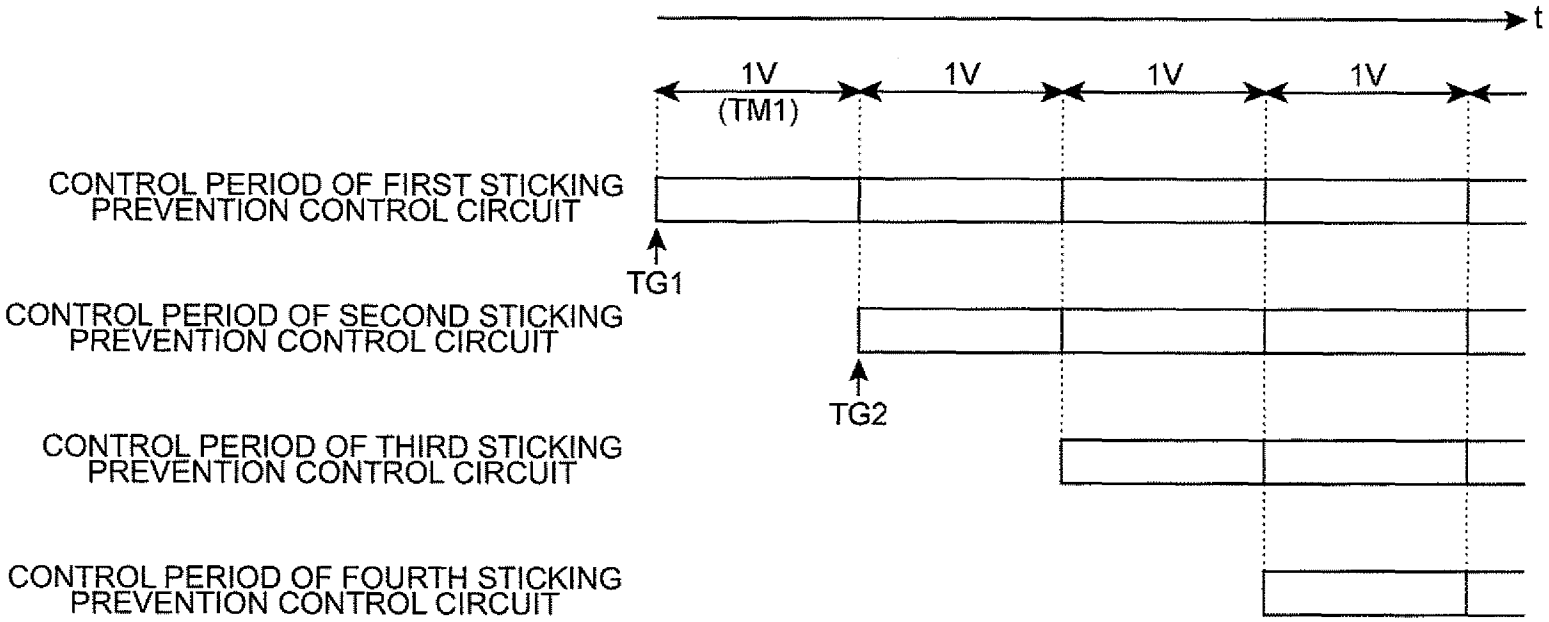
FIG. 5 is an explanatory diagram of an operation of a timing controller in FIG. 4.

FIG. 5 illustrates an explanatory diagram of an operation of the timing controller 50 in FIG. 4. FIG. 5 shows each control period of four types of sticking prevention control circuits included in the timing controller 50 with a time axis taken on a horizontal axis.

The timing controller 50 includes a still image continuous detection circuit (a still image continuous detection part) 110, an interval register 140, and a display control circuit (a display control part) 160. The still image continuous detection circuit 110 detects whether or not frames for which images to be displayed are still images are continuous based on the image data supplied from the host 60. The display control circuit 160 performs a plurality of types of sticking prevention control on image data of a frame in question or a display timing control signal corresponding to the image data so as to display each pixel with different brightness at given intervals. Then, the display control circuit 160 performs the above control, provided that the still image continuous detection circuit 110 detects that frames of still images are continuous. In the interval register 140, an interval time of control start timing during sticking prevention control of the image data or the display timing control signal is designated. The display control circuit 160 determines control start timing of each sticking prevention control, based on the control data corresponding to the interval time set in the interval register 140. For example, the interval time may be an integral multiple of one vertical scanning period as shown in FIG. 5.

Such a display control circuit 160 includes a first sticking prevention control circuit (a first sticking prevention control part) 162, a second sticking prevention control circuit (a second sticking prevention control part) 164, a third sticking prevention control circuit (a third sticking prevention control part) 166, and a fourth sticking prevention control circuit (a fourth sticking prevention control part) 168, each of which performs different sticking prevention control. For example, the second sticking prevention control circuit 164 controls image data or a display timing control signal with different control from that of the first sticking prevention control circuit 162 to perform sticking prevention control so as to display each pixel with different brightness at given intervals. Further, at least the first sticking prevention control circuit 162 and the second sticking prevention control circuit 164 control image data of an identical frame or a display timing control signal corresponding to the image data. In this case, in the interval register 140, control data corresponding to an interval time TM1 between a first control start timing TG1 (see FIG. 5) by the first sticking prevention control circuit 162 and a second control start timing TG2 (see FIG. 5) by the second sticking prevention control circuit 164 is set. After the control of the image data or the display timing control signal is started by the first sticking prevention control circuit 162, and the interval time TM1 (see FIG. 5) set in the interval register 140 has elapsed, the first sticking prevention control circuit 162 and the second sticking prevention control 164 control image data of an identical frame or a display timing control signal corresponding to the image data.

FIG. 5 shows a state where each of the second sticking prevention control circuit 162, the third sticking prevention control circuit 164, and the fourth sticking prevention control circuit 166 sequentially starts to control after lapse of the same interval time. That is to say, according to the present embodiment, any of the plurality of types of sticking prevention control may be performed, or a combination thereof may be performed concurrently. As a result, the sticking phenomenon can be minimized without depending upon the display unit 20 or the display image, compared with a case where one type of sticking prevention control is performed.

Here, the first sticking prevention control circuit 162 performs first mode sticking prevention control, the second sticking prevention control circuit for image 164 performs second mode sticking prevention control, the third sticking prevention control circuit for image 166 performs third mode sticking prevention control, and the fourth sticking prevention control circuit for image 168 performs fourth mode sticking prevention control.

Figure 6A:
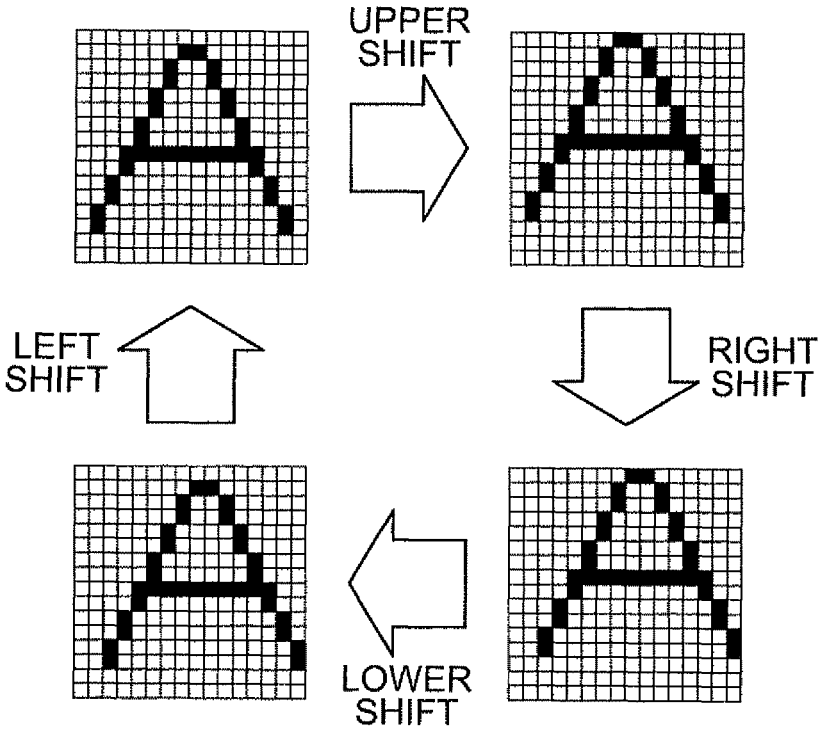
FIGS. 6(A) and 6(B) are explanatory diagrams of first mode sticking prevention control and second mode sticking prevention control according to the present embodiment.
Figure 6B:
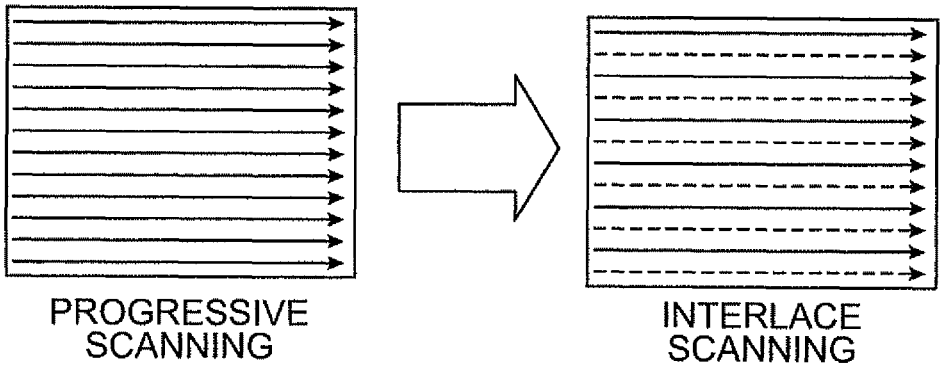

FIGS. 6(A) and 6(B) illustrate explanatory diagrams of first mode sticking prevention control and second mode sticking prevention control according to the present embodiment. FIG. 6(A) schematically shows changes in display images on a screen of the display panel 20 by first mode sticking prevention control. FIG. 6(B) schematically shows changes in scanning methods of a screen of the display panel 20 by second mode sticking prevention control.

Figure 7A:
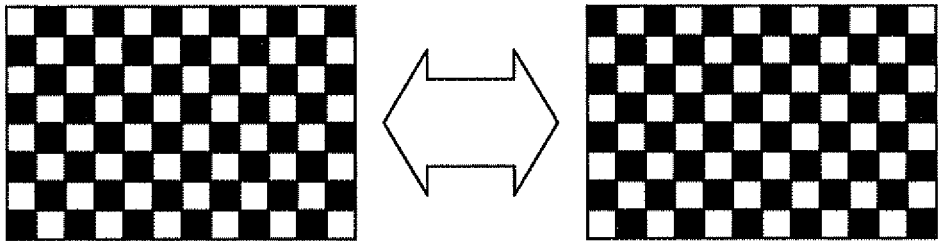
FIGS. 7(A) and 7(B) are explanatory diagrams of third mode sticking prevention control and fourth mode sticking prevention control according to the present embodiment.
Figure 7B:
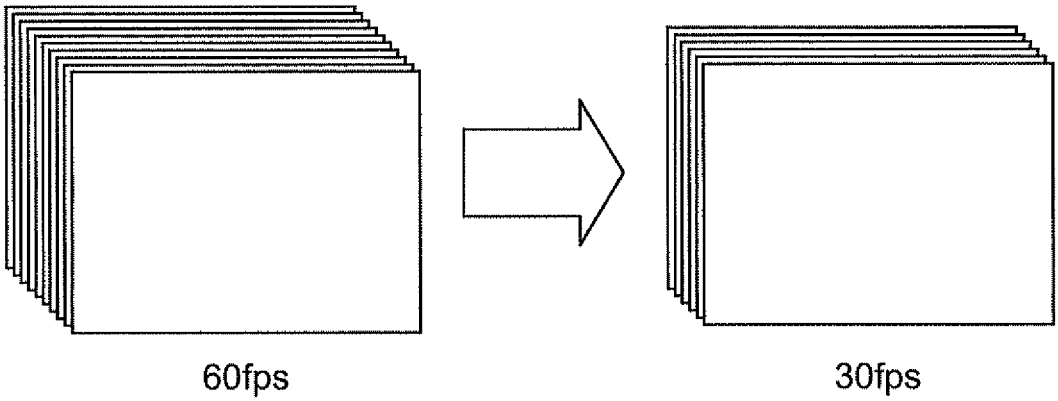

FIGS. 7(A) and 7(B) illustrate explanatory diagrams of third mode sticking prevention control and fourth mode sticking prevention control according to the present embodiment. FIG. 7(A) schematically shows changes in display images on a screen of the display panel 20 by third mode sticking prevention control. FIG. 7(B) schematically shows changes in frame rates of a screen of the display panel 20 by fourth mode sticking prevention control.

As shown in FIG. 6(A), the first mode is a mode of controlling image data so as to display each pixel forming an image with different brightness at given intervals by shifting an original display image by an amount corresponding to one dot after the lapse of a first interval time. More specifically, as shown in FIG. 6(A), preferably, the first mode is a mode of controlling image data so as to display each pixel forming an image with different brightness at given intervals by sequentially repeating, at every lapse of a given period of time, an upper shift (a first shift) of shifting an original display image by an amount corresponding to one scanning line in the first vertical scanning direction of a screen of the display panel 20, a right shift (a second shift) of shifting the original display image by an amount corresponding to one dot in the first horizontal scanning direction of the screen of the display panel 20, a lower shift (a third shift) of shifting the original display image by an amount corresponding to one scanning line in the opposite direction to the first horizontal scanning direction of the screen of the display panel 20, and a left shift (a fourth shift) of shifting the original display image by an amount corresponding to one dot in the opposite direction to the first horizontal scanning direction of the screen of the display panel 20. The first sticking prevention control circuit 162 is capable of controlling image data or a display timing control signal so as to display each pixel forming an image with different brightness at given intervals, as shown in FIG. 6(A), based on detection results of the still image continuous detection circuit 110.

On the other hand, as shown in FIG. 6(B), the second mode is a mode of controlling image data so as to display each pixel forming an image with different brightness at given intervals by switching between interlace scanning and progressive scanning at every lapse of the second interval time. The second sticking prevention control circuit 164 is capable of controlling image data or a display timing control signal so as to display each pixel forming an image with different brightness at given intervals, as shown in FIG. 6(B), based on detection results of the still image continuous detection circuit 110.

Further, as shown in FIG. 7(A), the third mode is a mode of controlling image data so as to display each pixel forming an image with different brightness at given intervals by lowering the frame rate for each pixel forming one dot or for each dot. The third sticking prevention control circuit 166 is capable of controlling image data or a display timing control signal so as to display each pixel forming an image with different brightness at given intervals, as shown in FIG. 7(A), based on detection results of the still image continuous detection circuit 110.

As shown in FIG. 7(B), the fourth mode is a mode of controlling image data so as to display each pixel forming an image with different brightness at given intervals, by thinning out an image display for each given frame. The fourth sticking prevention control circuit 168 is capable of controlling image data or a display timing control signal so as to display each pixel forming an image with different brightness at given intervals, as shown in FIG. 7(B), based on detection results of the still image continuous detection circuit 110.

Next, a specific configuration example of the timing controller 50 according to the present embodiment will be described.

Figure 8:
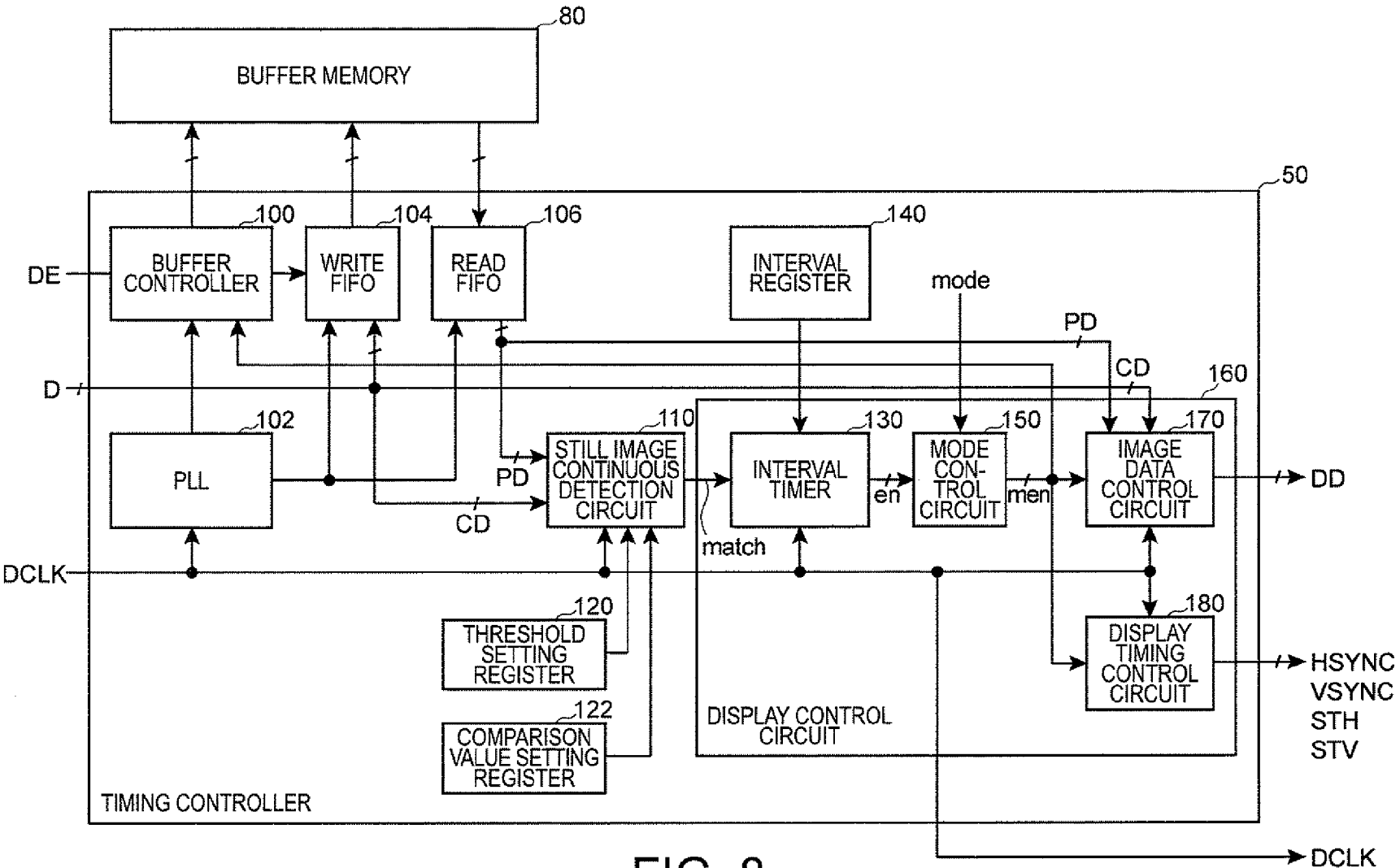
FIG. 8 is a block diagram of a configuration example of a timing controller according to the present embodiment.

FIG. 8 illustrates a block diagram of a configuration example of the timing controller 50 according to the present embodiment. In FIG. 8, the same parts as in FIG. 1 or FIG. 4 have the same reference numerals, description of which are omitted as necessary.

The timing controller 50 includes a buffer controller 100, a PLL (Phase-Locked Loop) circuit 102, a write FIFO (First-In First-Out) 104, a read FIFO 106, the still image continuous detection circuit 110, a threshold setting register 120, a comparison value setting register 122, the interval register 140, and the display control circuit 160. The display control circuit 160 includes an interval timer 130, a mode control circuit 150, an image data control circuit 170, and a display timing control circuit 180.

A data enable signal DE, image data D and a dot clock DCLK are input into the timing controller 50 from the host 60 or a clock signal generation circuit (not shown), and image data DD for display after image processing, the dot clock DCLK and a display timing control signal synchronous with the image data DD are supplied to the row driver 30 and the column driver 40. In the present embodiment, the display timing control signal includes, for example, a horizontal synchronous signal HSYNC for designating one horizontal scanning period, a vertical synchronous signal VSYNC for designating one vertical scanning period, a start pulse STH in the horizontal scanning direction, a start pulse STV in the vertical scanning direction and the dot clock DCLK.

The buffer controller 100 outputs an access control signal to the buffer memory 80 in synchronization with a synchronous clock from the data enable signal DE or the PLL circuit 102, and performs access control to the buffer memory 80. The PLL circuit 102 generates a synchronous clock for synchronizing the buffer controller 100, the write FIFO 104 and the read FIFO 106 based on the dot clock DCLK, and supplies the clock thereto. The write FIFO 104 functions as a write buffer for storing image data from the host 60 in the buffer memory 80, buffers the image data from the host 60 by control from the buffer controller 100, and outputs the buffered image data into the buffer memory 80. The read FIFO 106 functions as a read buffer of image data read from the buffer memory 80, buffers the image data read from the buffer memory 80 by control from the buffer controller 100, and outputs the buffered image data into the still image continuous detection circuit 110.

The still image continuous detection circuit 110 detects whether or not frames for which images to be displayed are still images are continuous. Therefore, the still image continuous detection circuit 110 detects whether or not the frames of the still images are continuous, based on a comparison result between a pixel value of each pixel forming an image of a current frame and a pixel value of each pixel forming an image of the immediately preceding frame, using image data D from the host 60 input into the write FIFO 104 as image data CD of the current frame and image data output from the read FIFO 106 as image data PD of the immediately preceding frame.

The comparison value setting register 122 functions as a detection condition designating register of the still image continuous detection circuit 110, and the still image continuous detection circuit 110 detects whether or not still images are continuous with a set value of the register as a detection condition. In the register, a region matching or mismatching between the current frame and the immediately preceding frame of the current frame is designated in one screen. Here, the matching or mismatching region means an area of the region matching between a current frame and the immediately preceding frame, or information corresponding to the area. The still image continuous detection circuit 110 detects whether or not the frames of the still images are continuous, based on the comparison result of each pixel in a region set in the register. This allows precision in which an image is detected as a still image to be controlled.

The comparison value setting register 122 serving as a detection condition designation register designates the number of blocks matching between a current frame and the immediately preceding frame of the current frame in each of a plurality of blocks into which one screen is divided. Then, the still image continuous detection circuit 110 performs a comparison between a pixel value of each pixel forming an image of a current frame (a frame in question) and a pixel value of each pixel forming an image of the immediately preceding frame, for each block, and detects whether or not frames of still images are continuous, based on the number of the blocks designated by the comparison value setting register 122. For example, if the number of blocks determined to be mismatching reaches the number of blocks designated by the comparison value setting register 122, the image is determined to be a moving image rather than a still image. As a result, degradation of image quality due to flicker or the like, which may be generated by sticking prevention control, can be suppressed. In addition, precision in which an image is detected as a still image according to the number of blocks, thus easily controlling the detection precision.

Further, in the present embodiment, the precision of determination of matching or mismatching for each block can be controlled, using the threshold setting register 120. For example, the number of mismatching pixels in a block is designated in the threshold setting register 120, and if the number of pixels mismatching in the block is equal to or less than the number of pixels set in the threshold setting register 120, it can be determined that the block matches. Alternatively, the number of pixels matching in a block is designated in the threshold setting register 120, and if the number of the pixels matching in the block is equal to or more than the number of pixels set in the threshold setting register 120, it can be determined that the block matches. In this way, even when still images having allowable noise are continuous, without exact detection of the continuity of still images, an event can be avoided where the images are determined to be moving images.

A detection result signal match corresponding to the detection result by the still image continuous detection circuit 110 is input into the interval timer 130. The interval timer 130 is connected with the interval register 140. Control data corresponding to an interval time of execution start timing of each of a plurality of sticking prevention control is set in the interval register 140. The interval timer 130 starts counting, provided that it is detected that frames of still images are continuous according to the detection result signal match, and, each time the interval time set in the interval register 140 has elapsed, an enable signal en corresponding to the sticking prevention control among a plurality of enable signals is changed to be active.

The enable signal en from the interval timer 130 is input into the mode control circuit 150. A mode setting signal mode is also input into the mode control circuit 150. Based on the enable signal en and the mode setting signal mode, a mode enable signal men is output. The mode setting signal mode is a signal for designating which of a plurality of types of sticking prevention control should be executed, and, for example, is designated by the host 60 setting in a control register (not shown) of the timing controller 50.

The mode enable signal men from the mode control circuit 150 is input into the image data control circuit 170 and the display timing control circuit 180. The image data control circuit 170 controls image data corresponding to a still image so as to display each pixel forming an image with different brightness at given intervals by controlling the image data input into the write FIFO 104 according to the mode enable signal men. The display timing control circuit 180 controls a display timing control signal synchronous with the image data corresponding to a still image so as to display each pixel forming an image with different brightness at given intervals by controlling a display timing control signal, which is input into the timing controller 50 or is generated therein, according to the mode enable signal men.

Now, each part of the timing controller 50 will be described in detail.

Figure 9:
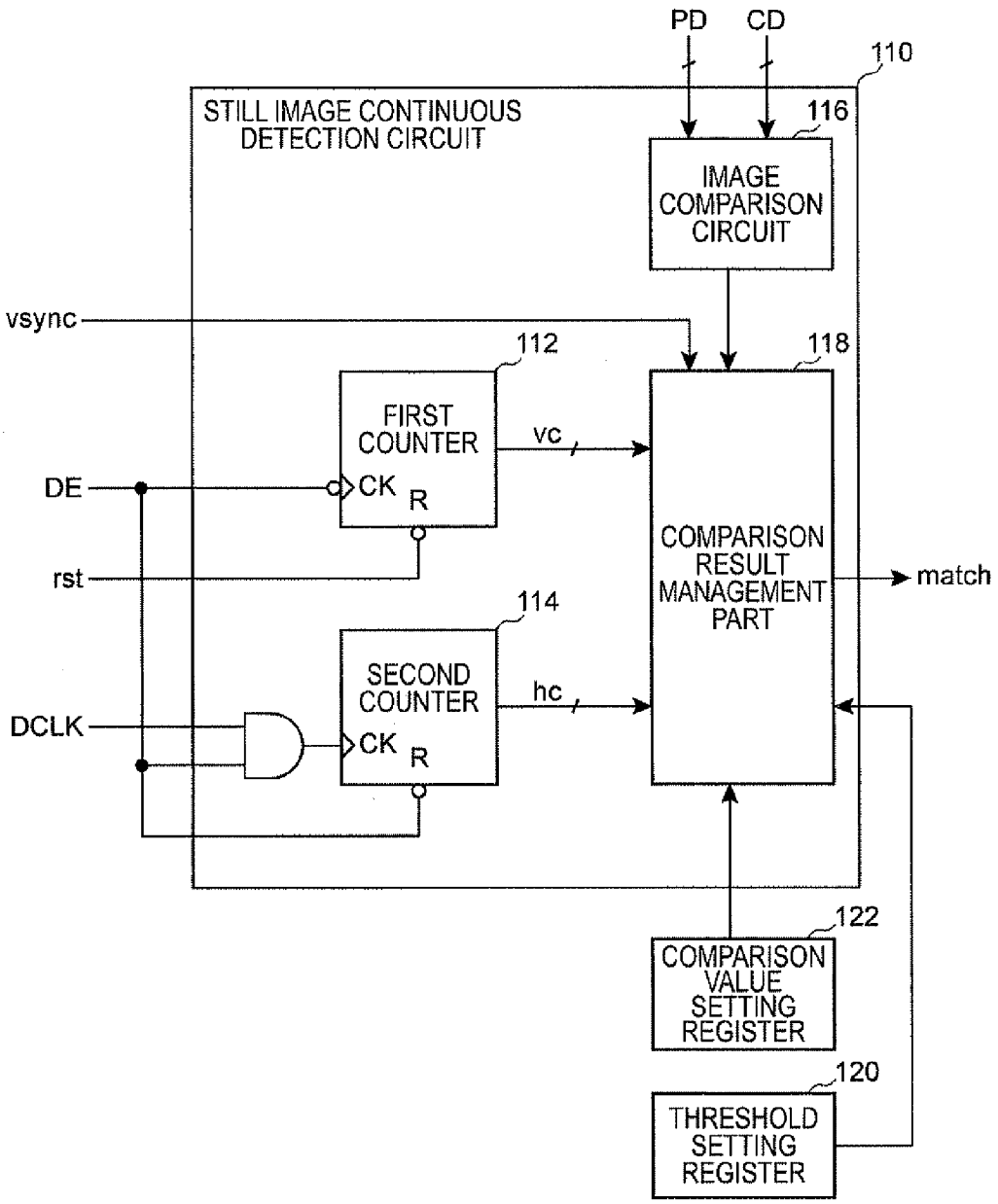
FIG. 9 is a block diagram of a configuration example of a still image continuous detection circuit in FIG. 8.

FIG. 9 illustrates a block diagram of a configuration example of a still image continuous detection circuit 110 in FIG. 8. The configuration of the still image continuous detection circuit 110 is not limited to the configuration in FIG. 9. FIG. 9 illustratively includes the threshold setting register 120 and the comparison value setting register 122 in FIG. 8.

Figure 10:
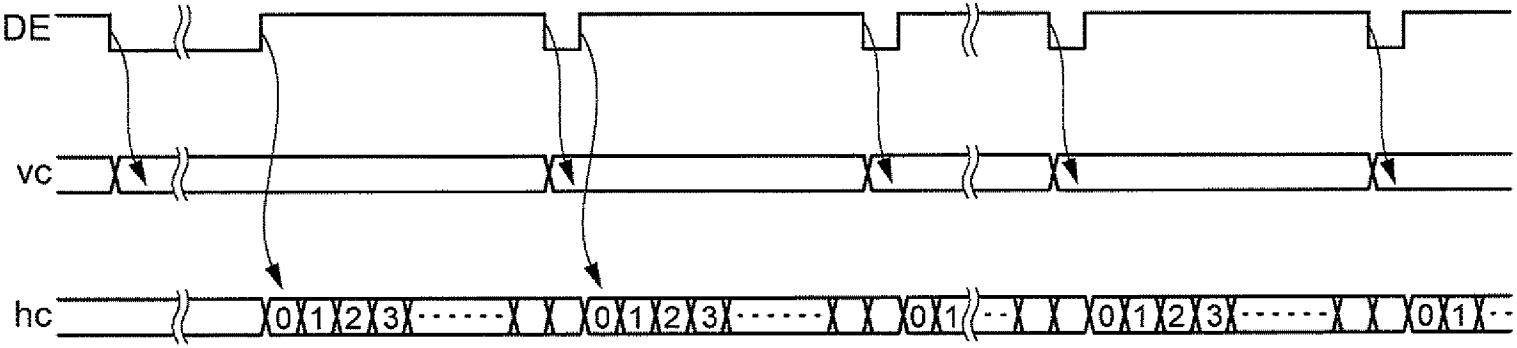
FIG. 10 is a timing view of an operational example of a first counter and a second counter in FIG. 9.

FIG. 10 illustrates a timing view of an operational example of a first counter and a second counter in FIG. 9.

Figures 11A, 11B, 12:
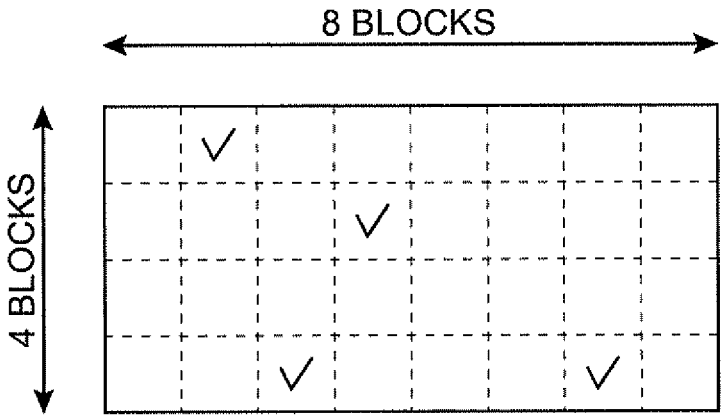
FIGS. 11(A) and 11(B) are explanatory diagrams of operations of an image comparison circuit in FIG. 9.
FIG. 12 is an explanatory diagram of an operation of a comparison result management part in FIG. 9.

FIGS. 11(A) and 11(B) illustrate explanatory diagrams of operations of an image comparison circuit in FIG. 9, and illustrate examples of pixel values of respective pixels forming a given horizontal scanning line.

FIG. 12 illustrates an explanatory diagram of an operation of a comparison result management part in FIG. 9.

The still image continuous detection circuit 110 eludes a first counter 112, a second counter 114, an image comparison circuit 116, and a comparison result management part 118.

The first counter 112 is a counter for counting the number of horizontal scanning lines in one vertical scanning period as a count value vc. The second counter 114 is a counter for counting the number of pixels in one horizontal scanning line as a count value hc. The count values vc, hc are input into the comparison result management part 118. As shown in FIG. 10, the first counter 112 starts count-up at the falling edge of a data enable signal DE, and initializes a count value based on a reset signal rst generated by a start pulse and the like in the vertical scanning direction, for example. In addition, as shown in FIG. 10, the second counter 114 starts count-up in synchronization with the dot clock DCLK based on the falling edge of the data enable signal DE, and, for example, resets a count value at the falling edge of the data enable signal DE. By the count values vc, hc from the first counter 112 and the second counter 114, pixels compared by the image comparison circuit 116 are identified.

Based on image data CD of the current frame and image data PD of the immediately preceding frame of the current frame, the image comparison circuit 116 compares pixel values of respective pixels forming both the images with each other to determine whether or not still images are continuous between the frames. Comparison results of the image comparison circuit 116 are input into the comparison result management part 118. For example, the image comparison circuit 116 compares pixel values of the respective pixels of the image data CD, PD with each other, as shown in FIG. 11(A), in synchronization with the dot clock DCLK to determine whether or not both the values match each other. FIG. 11(A) shows an example where both the images match, and FIG. 11(B) shows an example where both images mismatch.

The comparison result management part 118 manages comparison results from the image comparison circuit 116, being associated with pixel positions in an image, based on a count value vc from the first counter 112 and count value hc from the second counter 114. In the present embodiment, the comparison result management part 118 manages whether or not both images match for each of a plurality of blocks into which one screen is divided. Therefore, the comparison result management part 118 identifies block positions in an image with reference to upper bits of sequentially updated count values vc, hc, and manages whether or not each pixel matches in the block. For example, the comparison result management part 118 manages whether or not a mismatching pixel is present for each block obtained by dividing one screen into 8 portions in the horizontal direction and four portions in the vertical direction, as shown in FIG. 12, and generates a detection result signal match based on the management result.

Further, as described above, the comparison result management part 118 generates a detection result signal match, based on control data corresponding to a comparison value set in the comparison value setting register 122. The number of blocks in which both images match is designated as the comparison value. Thus, since the overall number of blocks is known, the rate of matching blocks can be designated as a comparison value. For example, in FIG. 12, when a block in which an mismatching pixel is present is marked, and "30" is designated as a comparison value, the comparison result management part 118 outputs a detection result signal match meaning that both images mismatch. When "25" is designated as a comparison value, the comparison result management part 118 outputs a detection result signal match designating that both images match. The comparison result management part 118 changes such a detection result signal match in the active timing of an internal vertical synchronous signal vsync.

As a comparison value set in the comparison value setting register 122, the number of blocks in which both images mismatch may be designated. This case also means that the rate of mismatching blocks may be designated as a comparison value because the overall number of blocks is known. For example, in FIG. 12, when a block in which a mismatching pixel is present is marked, and "3" is designated as a comparison value, the comparison result management part 118 outputs a detection result signal match meaning that both images mismatch. When "5" is designated as a comparison value, the comparison result management part 118 outputs a detection result signal match designating that both images match. The comparison result management part 118 changes such a detection result signal match in the active timing of an internal vertical synchronous signal vsync.

Preferably, the comparison result management part 118 determines matching or mismatching for each block, based on control data set in the threshold setting register 120. That is to say, it is preferable to determine a block in which both images match or a block in which both images mismatch, based on control data corresponding to a threshold value set in the threshold setting register 120. As a result, an adverse effect of noise in a block can be eliminated, and a fact that still images are continuous between frames can be detected.

Although the present embodiment describes that the still image continuous detection circuit 110 compares both images for each block, the present invention is not limited thereto. The still image continuous detection circuit 110 may compare both images for each pixel and may detect whether or not still images are continuous, based on the comparison result. In this case, preferably, based on control data corresponding to a comparison value set in the comparison value setting register 122, the still image continuous detection circuit 110 detects whether or not still images are continuous based on the comparison result of both images for each pixel.

Figure 13:
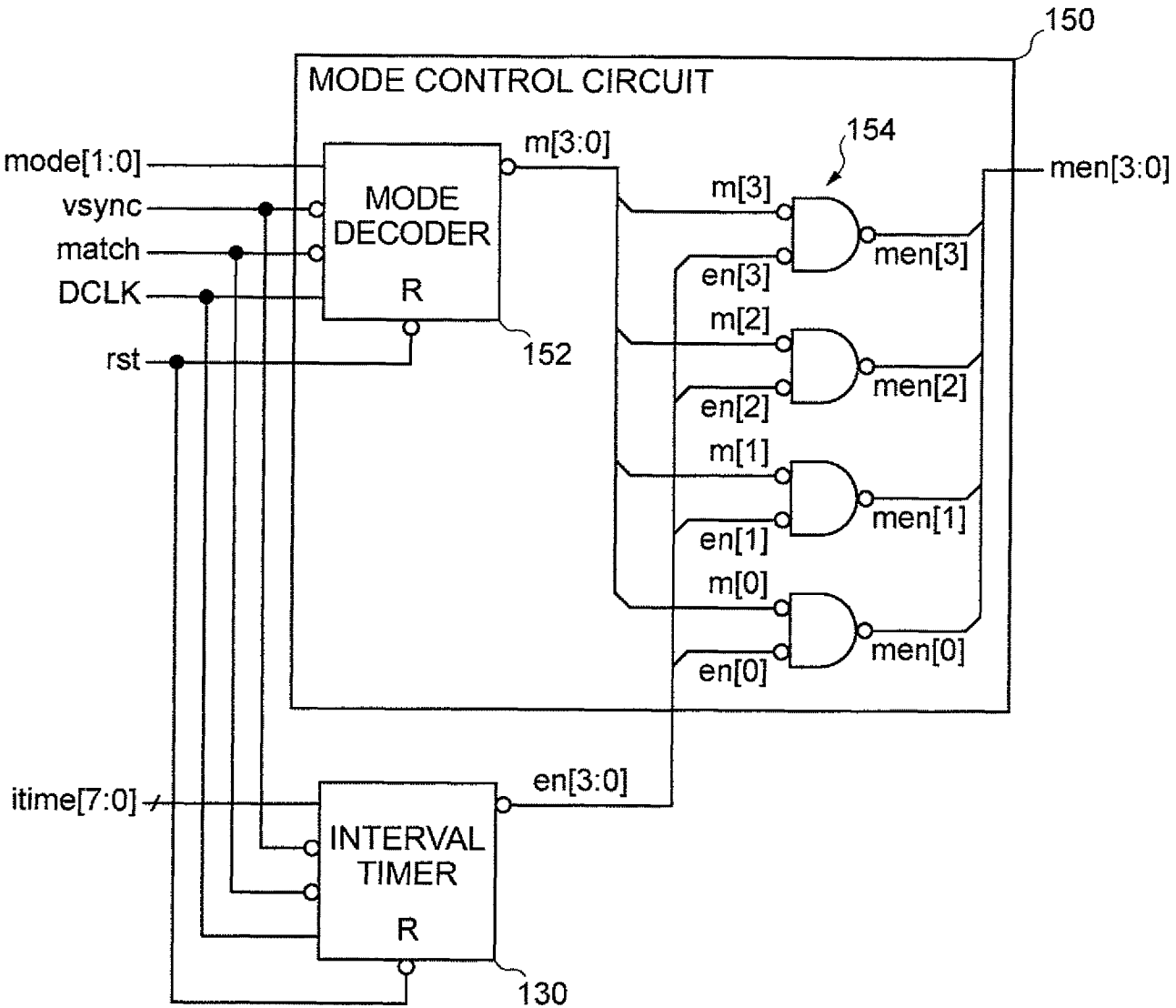
FIG. 13 is a view illustrating a configuration example of an interval timer and a mode control circuit in FIG. 8.

FIG. 13 illustrates a configuration example of the interval timer 130 and the mode control circuit 150 in FIG. 8. The following describes that single sticking prevention control or a combination of a plurality of types of sticking prevention control is designated according to a 2-bit mode setting signal mode [1:0].

Figure 14:
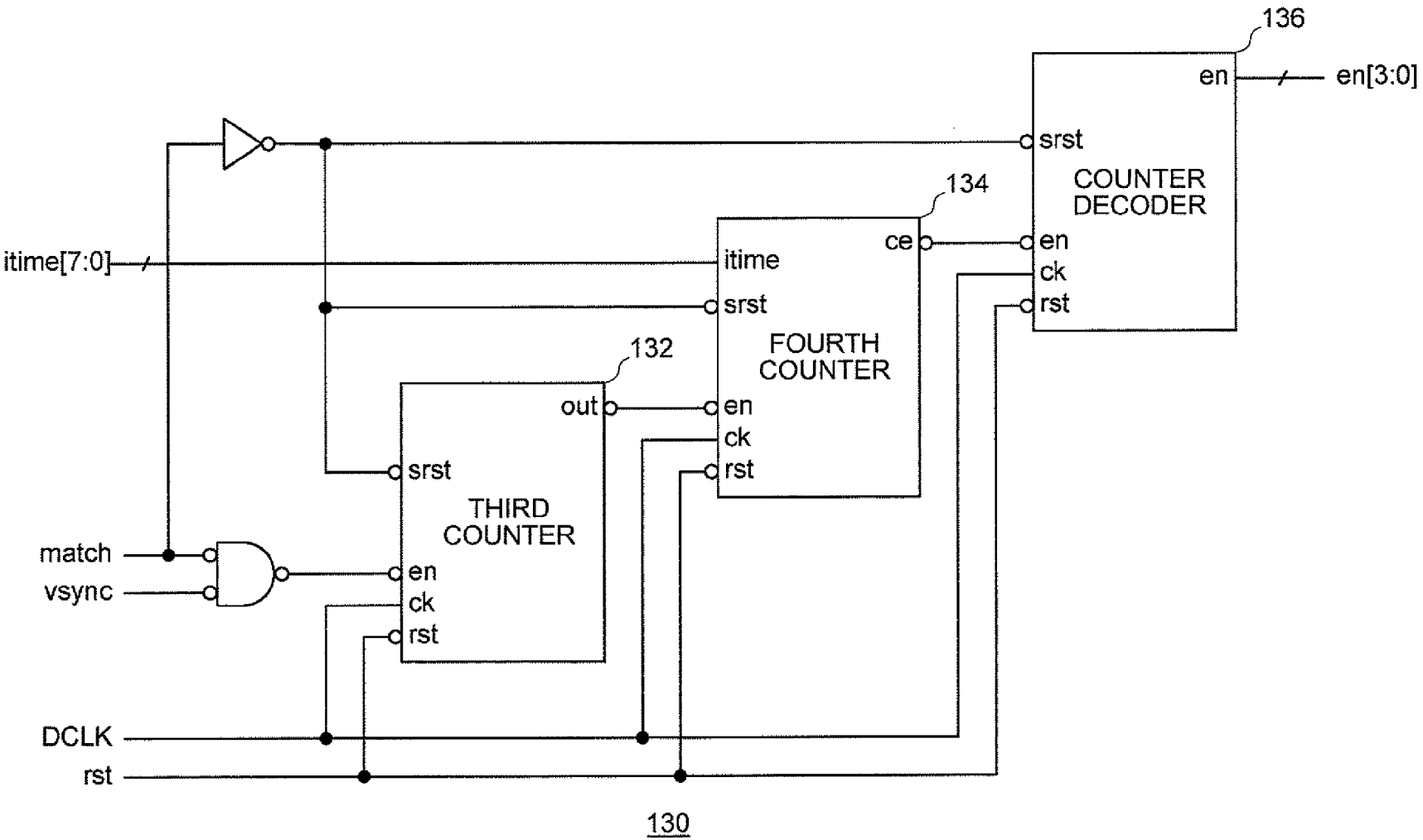
FIG. 14 is a view illustrating a detailed configuration example of an interval timer in FIG. 13.

FIG. 14 illustrates a detailed configuration example of the interval timer 130 in FIG. 13.

Figure 15:
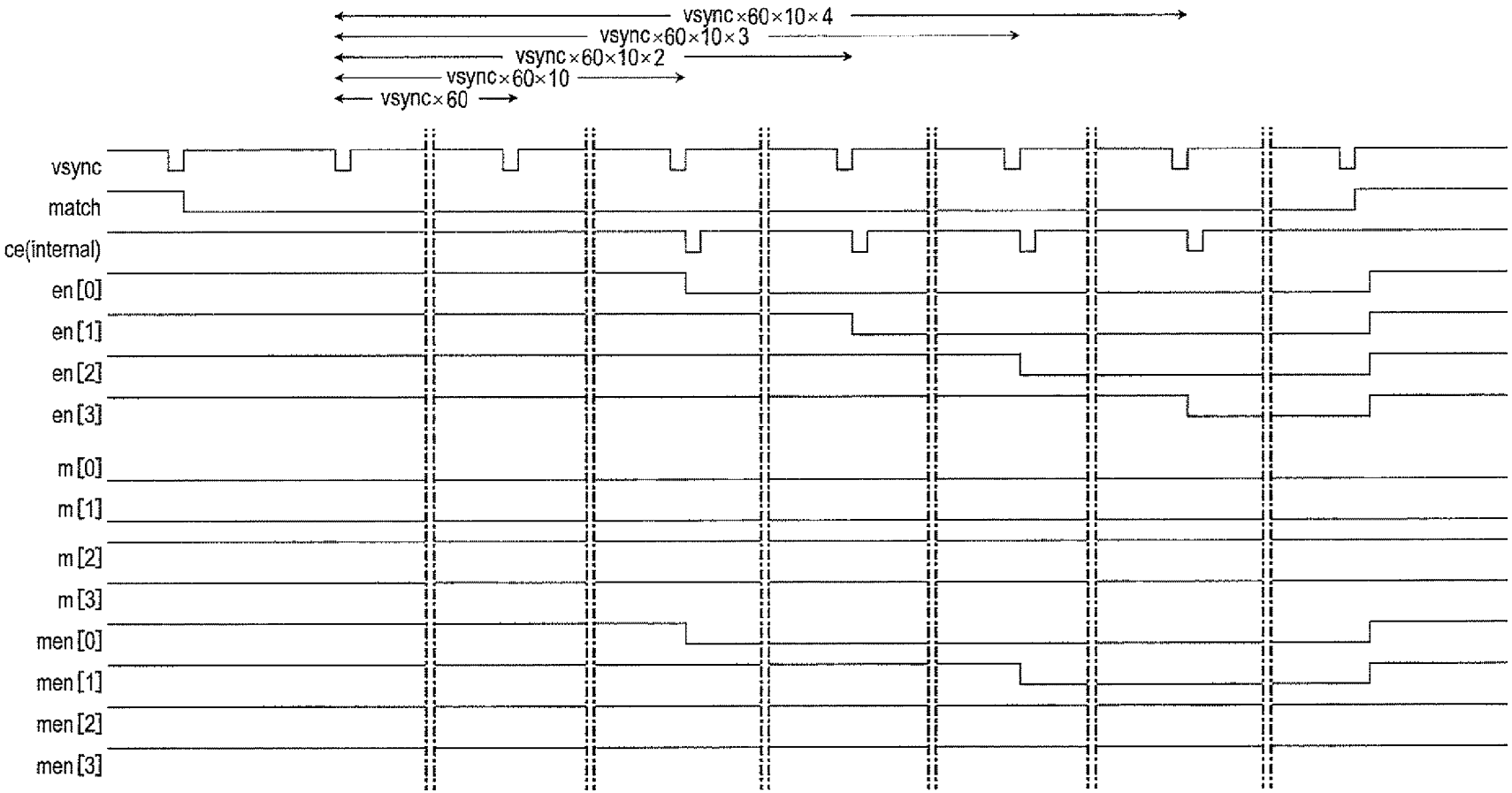
FIG. 15 is a timing diagram of an operational example of an interval timer and a mode control circuit in FIG. 13.

FIG. 15 illustrates a timing diagram of an operational example of the interval timer 130 and the mode control circuit 150 in FIG. 13.

The interval timer 130 measures the number internal vertical synchronous signals vsync while it is being detected that still images are continuous according to a detection result signal match. As shown in FIG. 14, the interval timer 130 includes a third counter 132, a fourth counter 134, and a counter decoder 136. Control data itime[7:0] set in the interval register 140 is input into the interval timer 130. After it is detected that still images are continuous according to a detection result signal match in synchronization with an internal vertical synchronous signal vsync, the third counter 132 makes an output signal out active four times for each predetermined period of time. The output signal out is input into an enable terminal of the fourth counter 134, and as shown in FIG. 15, an internal signal ce is kept at an L level only during a period of one dot clock each time the period set in the control data itime[7:0] has elapsed. FIG. 15 shows an example where an internal signal ce is kept at an L level only during a period of one dot clock every 60 vertical scanning periods.

The counter decoder 136 changes enable signals en[0], en[1], en[2], en[3] to an L level in order each time an internal signal ce from the fourth counter 134 is at an L level. The enable signal en[3:0] is input into the mode control circuit 150. In the third counter 132, the fourth counter 134 and the counter decoder 136 of the interval timer 130, a detection result signal match is input into a synchronous reset terminal srst, and when it is detected that still images are not continuous according to the detection result signal match, an internal state is initialized.

As shown in FIG. 13, the mode control circuit 150 includes a mode decoder 152 and a combined circuit 154. A mode setting signal [1:0], an internal vertical synchronous signal vsync, a detection result signal match and the like are input into the mode decoder 152. The mode setting signal [1:0] is a signal obtained by encoding any of four types of sticking prevention control or the designation of a combination thereof.

FIG. 16 illustrates an explanatory diagram of an operation of the mode decoder 152 in FIG. 13.

When it is detected that still images are continuous according to a detection result signal match, the mode decoder 152 decodes a mode setting signal mode[1:0] into a 4-bit mode set decode signal m[3:0], as shown in FIG. 16, for example, in synchronization with an internal vertical synchronous signal vsync. In the mode set decode signal m[3:0], a signal of each bit corresponds to one of four types of sticking prevention control. When the signal of each bit is "0", the sticking prevention control corresponding thereto is not performed, and when the signal is "1" the sticking prevention control corresponding thereto is performed. Accordingly, when at least two bits in the mode set decode signal m[3:0] are sticking prevention control is concurrently performed. FIG. 15 illustrates an example where a mode setting signal mode[1:0] is 2'b01.

The mode control circuit 150 causes the combined circuit 154 to calculate respective bits of a mode set decode signal m[3:0] and an enable signal en[3:0] to output a mode enable signal men[3:0]. As a result, as shown in FIG. 15, a mode set decode signal m by which an enable signal en becomes active is at an L level, and the sticking prevention control corresponding thereto is performed.

The mode enable signal men[3:0] generated in this way is input into the display control circuit 160 as shown in FIG. 8.

Figure 17:
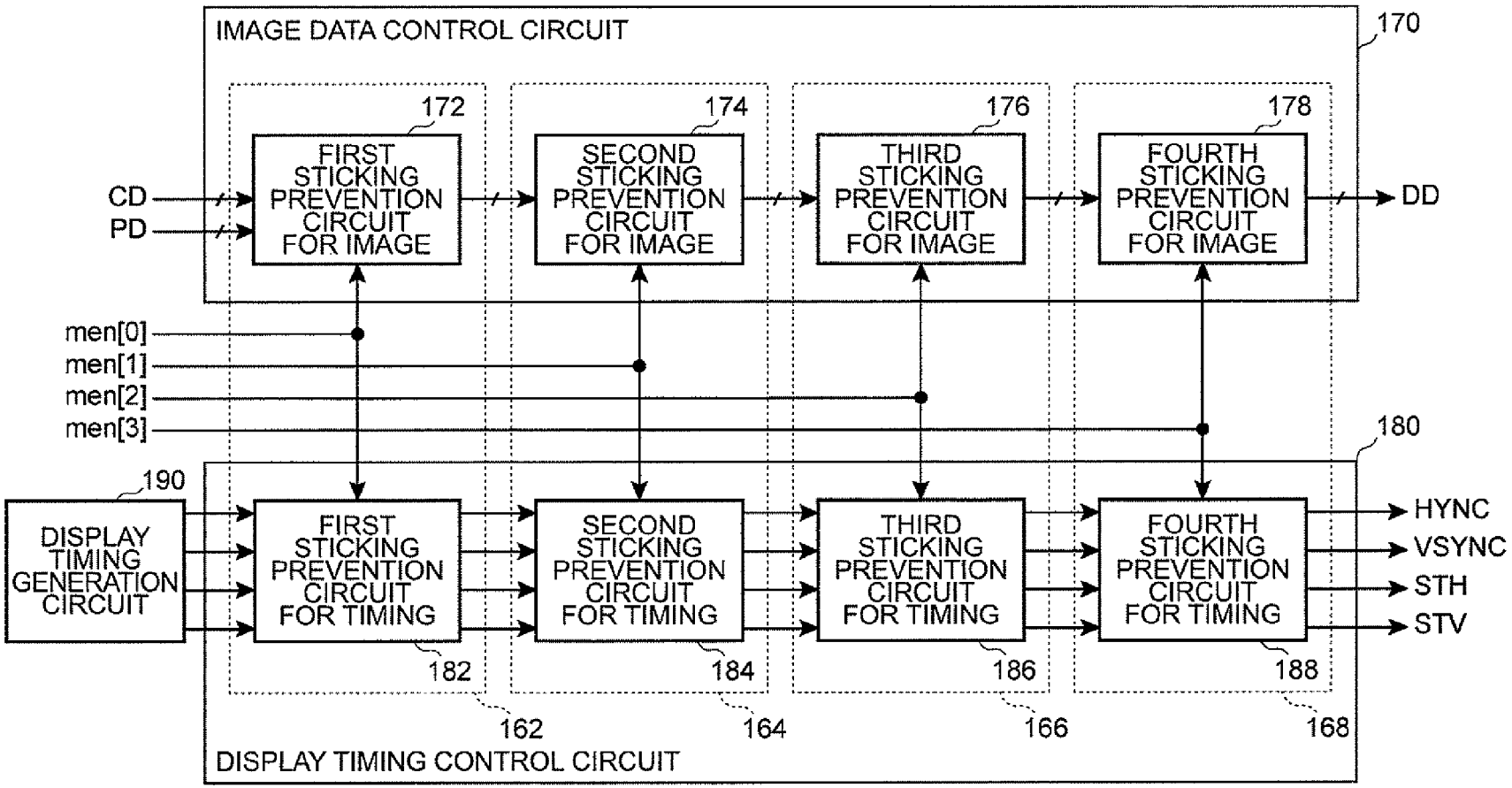
FIG. 17 is a block diagram of a configuration example of an image data control circuit and a display timing control circuit of a display control circuit in FIG. 8.

FIG. 17 illustrates a block diagram of a configuration example of the image data control circuit 170 and the display timing control circuit 180 of the display control circuit 160 in FIG. 8. FIG. 17 illustratively includes a display timing generation circuit 190 in the timing controller 50 not shown in FIG. 8. Although FIG. 17 schematically shows a sticking prevention circuit provided for each of four types of sticking prevention control to control image data or a display timing control signal, in a case where sticking prevention control can be performed without control of image data or a display timing control signal, image data or a display timing control signal from a previous stage may be output to the subsequent stage as it is through the sticking prevention circuit. In this case, a configuration may be adopted in which a sticking prevention circuit performing no control of the image data or the display timing control signal is omitted from the configuration in FIG. 17.

The image data control circuit 170 includes a first sticking prevention circuit for image 172, a second sticking prevention circuit for image 174, a third sticking prevention circuit for image 176, and a fourth sticking prevention circuit for image 178. The first sticking prevention circuit for image 172, the second sticking prevention circuit for image 174, the third sticking prevention circuit for image 176, and the fourth sticking prevention circuit for image 178 are connected in series. Image data CD of a current frame and image data PD of the immediately preceding frame are input into the first sticking prevention circuit for image 172. In performing sticking prevention control, predetermined control is performed on the image data PD. In the case where sticking prevention control is not performed, on the other hand, the image data CD is output as it is. Each of the remaining sticking prevention circuits for image performs control on the image data controlled at the previous stage. At this time, a corresponding mode enable signal men is input into each of the sticking prevention circuits for image. When the mode enable signal men is active, unique control to each of the sticking prevention circuits for image is performed. When the mode enable signal men is inactive, on the other hand, the image data from the previous stage is output to the sticking prevention circuit at the subsequent stage as it is.

The display timing generation circuit 190 generates an internal horizontal synchronous signal hsync, an internal vertical synchronous signal vsync, an internal start pulse sth in the horizontal scanning direction and an internal start pulse stv in the vertical scanning direction, and outputs them to the display timing control circuit 180.

The display timing control circuit 180 includes a first sticking prevention circuit for timing 182, a second sticking prevention circuit for timing 184, a third sticking prevention circuit for timing 186, and a fourth sticking prevention circuit for timing 188. The first sticking prevention circuit for timing 182, the second sticking prevention circuit for timing 184, a third sticking prevention circuit for timing 186, and the fourth sticking prevention circuit for timing 188 are connected in series. The internal horizontal synchronous signal hsync, the internal vertical synchronous signal vsync, the internal start pulse sth in the horizontal scanning direction, and the internal start pulse stv in the vertical scanning direction, which are generated by the display timing generation circuit 190, are input into the first sticking prevention circuit for timing 182, which in turn performs predetermined control on these display timing control signals. Each of the remaining sticking prevention circuits for timing performs control on display timing control signals controlled at the previous stage. At this time, a corresponding mode enable signal men is input into each of the sticking prevention circuits for timing. When the mode enable signal men is active, unique control to each of the sticking prevention circuits for timing is performed. When the mode enable signal men is inactive, on the other hand, the display timing control signal from the previous stage is output to the sticking prevention circuit at the subsequent stage as it is.

The first sticking prevention circuit for image 172 and the first sticking prevention circuit for timing 182 achieve a function of the first sticking prevention control circuit 162 in FIG. 4, which control the image data and the display timing control signal to perform the first mode sticking prevention control. The second sticking prevention circuit for image 174 and the second sticking prevention circuit for timing 184 achieve a function of the second sticking prevention control circuit 164 in FIG. 4, which control the image data and the display timing control signal to perform the second mode sticking prevention control. The third sticking prevention circuit for image 176 and the third sticking prevention circuit for timing 186 achieve a function of the third sticking prevention control circuit 166 in FIG. 4, which control the image data and the display timing control signal to perform the third mode sticking prevention control. The fourth sticking prevention circuit for image 178 and the fourth sticking prevention circuit for timing 188 achieve a function of the fourth sticking prevention control circuit 168 in FIG. 4, which control the image data and the display timing control signal to perform the fourth mode sticking prevention control.

With such a configuration, the image data control circuit 170 and the display timing control circuit 180 are capable of controlling a display timing control signal so as to display each pixel forming an image with different brightness at given intervals based on the detection result of the still image continuous detection circuit 110.

Next, control examples of image data and display timing control in each mode will be specifically described.

<First Mode>

Figure 18:
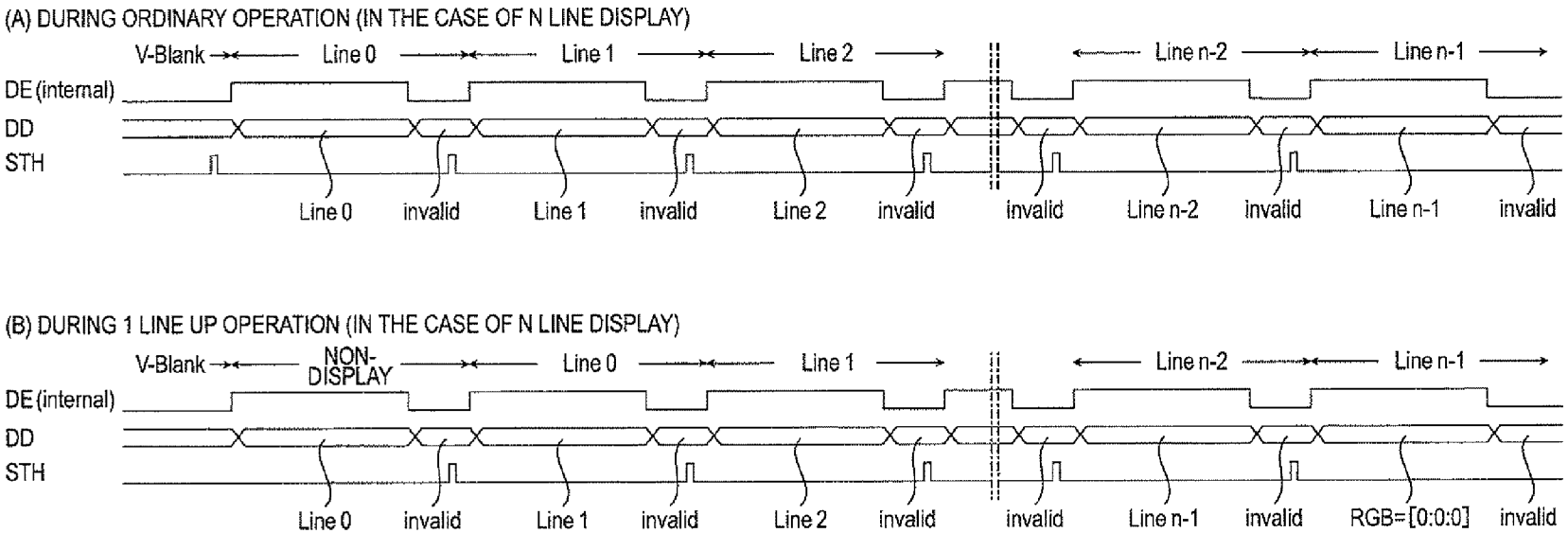
FIGS. 18(A) and 18(B) are timing diagrams of control examples of an upper shift in the first mode.

FIGS. 18(A) and 18(B) illustrate timing diagrams of control examples of an upper shift in a first mode. FIGS. 18(A) and 18(B) show an internal data enable signal DE, image data DD to be output and a start pulse STH. Moreover, FIG. 18(A) shows the timing of a control example during ordinary operation in displaying a screen of the number of lines n (n: an integer of 2 or more) and FIG. 18(B) shows the timing of an control example of an upper shift in the first mode in displaying a screen of the number of lines n.

In the case of the upper shift, the first sticking prevention circuit for image 172 of the image data control circuit 170 does not change read-out control of image data from the read FIFO 106, and the first sticking prevention circuit for timing 182 of the display timing control circuit 180 delays a start pulse STH in the horizontal scanning direction or a start pulse STV in the vertical scanning direction by an amount corresponding to one line. The first sticking prevention circuit for image 172 controls image data so that, for example, each of pixel values of R-component, G-component and B-component forming image data displays a black line of "0" at one line of the last $n^{th}$ line. Thus, as shown in FIG. 18(B), the first line in FIG. 18(A) is made invisible and a black line is displayed at the last line.

Figure 19:
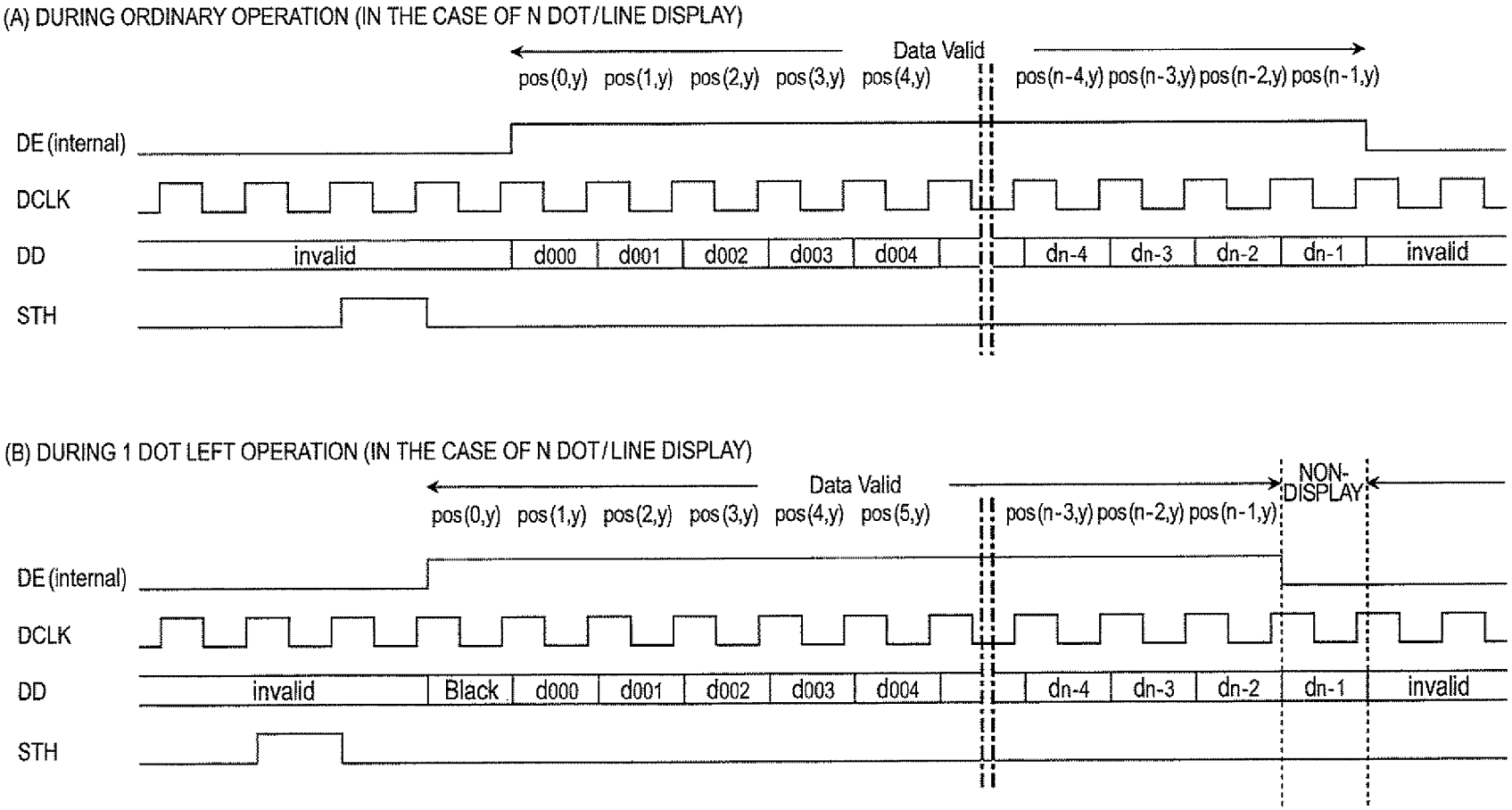
FIGS. 19(A) and 19(B) are timing diagrams of control examples of a right shift in the first mode.

FIGS. 19(A) and 19(B) illustrate timing diagrams of control examples of a right shift in the first mode. FIGS. 19(A) and 19(B) show an internal data enable signal DE, image data DD to be output and start pulse STH in the same way as in FIGS. 18(A) and 18(B). Moreover, FIG. 19(A) shows the timing of a control example during ordinary operation in displaying a screen in which one line is formed from n dots (n: an integer of 2 or more), and FIG. 19(B) shows the timing of a control example of a right shift in the first mode in displaying a screen of the number of lines n in which one line is formed from n dots.

In the case of a right shift, the first sticking prevention circuit for image 172 of the image data control circuit 170 performs read-out control by delaying read-out of image data from the read FIFO 106 by an amount corresponding to one dot clock. Alternatively, the first sticking prevention circuit for timing 182 of the display timing control circuit 180 outputs the image data by advancing a start pulse STH in the horizontal scanning direction by an amount corresponding to one dot clock. For example, as shown in FIG. 19(B), by advancing the start pulse STH by an amount corresponding to one dot clock, the first sticking prevention circuit for image 172 controls image data so that, for example, each of pixel values of R-component, G-component and B-component forming image data becomes a black dot of "0" at a first dot of each line, thus making the last dot of each line shown in FIG. 19(A) invisible and displaying, for example, a black dot at the first dot of each line.

Figure 20:
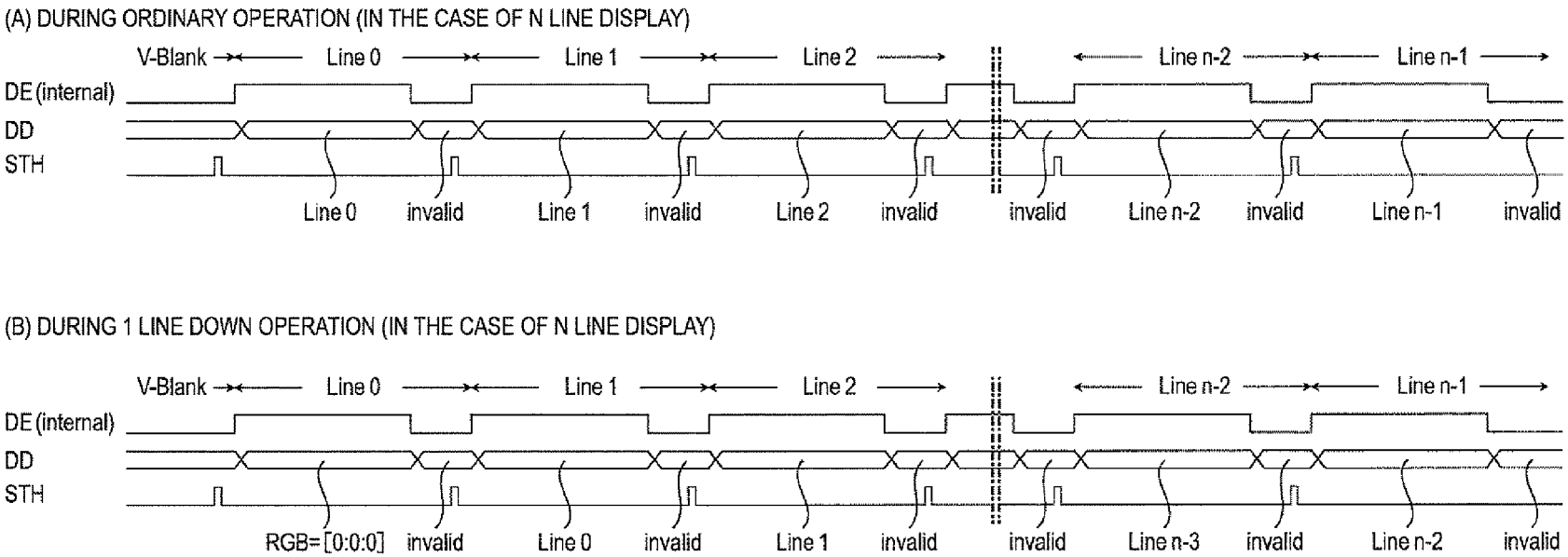
FIGS. 20(A) and 20(B) are timing diagrams of control examples of a lower shift in the first mode.

FIGS. 20(A) and 20(B) illustrate timing diagrams of control examples of a lower shift in a first mode. FIGS. 20(A) and 20(B) show an internal data enable signal DE, image data DD to be output and start pulse STH. Moreover, FIG. 20(A) shows the timing of a control example during ordinary operation in displaying a screen of the number of lines n (n: an integer of 2 or more). On the other hand, FIG. 20(B) shows the timing of a control example of a lower shift in the first mode in displaying the screen of the number of lines n.

In the case of a lower shift, the first sticking prevention circuit for image 172 of the image data control circuit 170 does not change read-out control of image data from the read FIFO 106, and the first sticking prevention circuit for timing 182 of the display timing control circuit 180 does not perform control of a display timing control signal. The first sticking prevention circuit for image 172 only controls image data so that, for example, each of pixel values of R-component, G-component and B-component forming image data displays a black line of "0" at the first line, retains the image data at a line memory, and outputs image data after the control with a time lag of one line. Thus, as shown in FIG. 20(B), a black line can be displayed at the first line in FIG. 20(A) and one line before the last line shown in FIG. 20(A) can be displayed as the last line.

Figure 21:
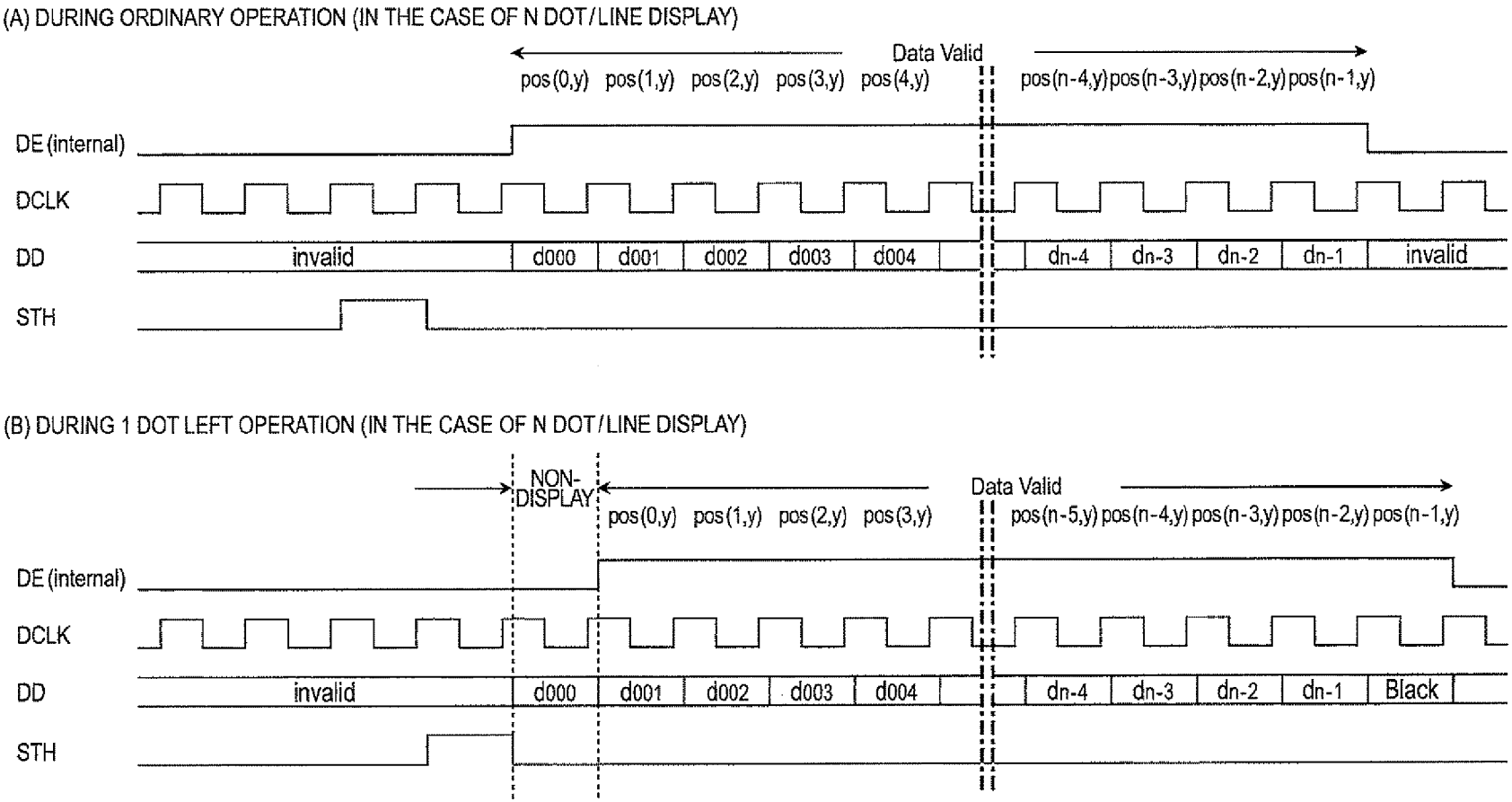
FIGS. 21(A) and 21(B) are timing diagrams of control examples of a left lower shift in the first mode.

FIGS. 21(A) and 21(B) illustrate timing diagrams of control examples of a left shift in the first mode. FIGS. 21(A) and 21(B) show an internal data enable signal DE, image data DD to be output and start pulse STH in the same way as in FIGS. 18(A) and 18(B). In addition, FIG. 21(A) shows the timing of a control example during ordinary operation in displaying a screen in which one line is formed from n dots (n: an integer of 2 or more). On the other hand, FIG. 21(B) shows the timing of a control example of a left shift in the first mode in displaying a screen of the number of lines n in which one line is formed from n dots.

In the case of a left shift, the first sticking prevention circuit for image 172 of the image data control circuit 170 performs read-out control by advancing read-out of image data from the read FIFO 106 by an amount corresponding to one dot clock. Alternatively, the first sticking prevention circuit for timing 182 of the display timing control circuit 180 outputs the image data by delaying a start pulse STH in the horizontal scanning direction by an amount corresponding to one dot clock. For example, as shown in FIG. 21(B), by delaying the start pulse STH by an amount corresponding to one dot clock, the first sticking prevention circuit for image 172 controls image data so that, for example, each of pixel values of R-component, G-component and B-component forming image data displays a black dot of "0", thus making the first dot of each line shown in FIG. 21(A) invisible and displaying, for example, a black dot at the last dot of each line.

The first sticking prevention circuit for image 172 can sequentially repeat shifts in four directions of controlling image data as described above. The first sticking prevention circuit for timing 182 can also sequentially repeat shifts in four directions of controlling the display timing control signal as described above.

<Second Mode>

Figure 22:
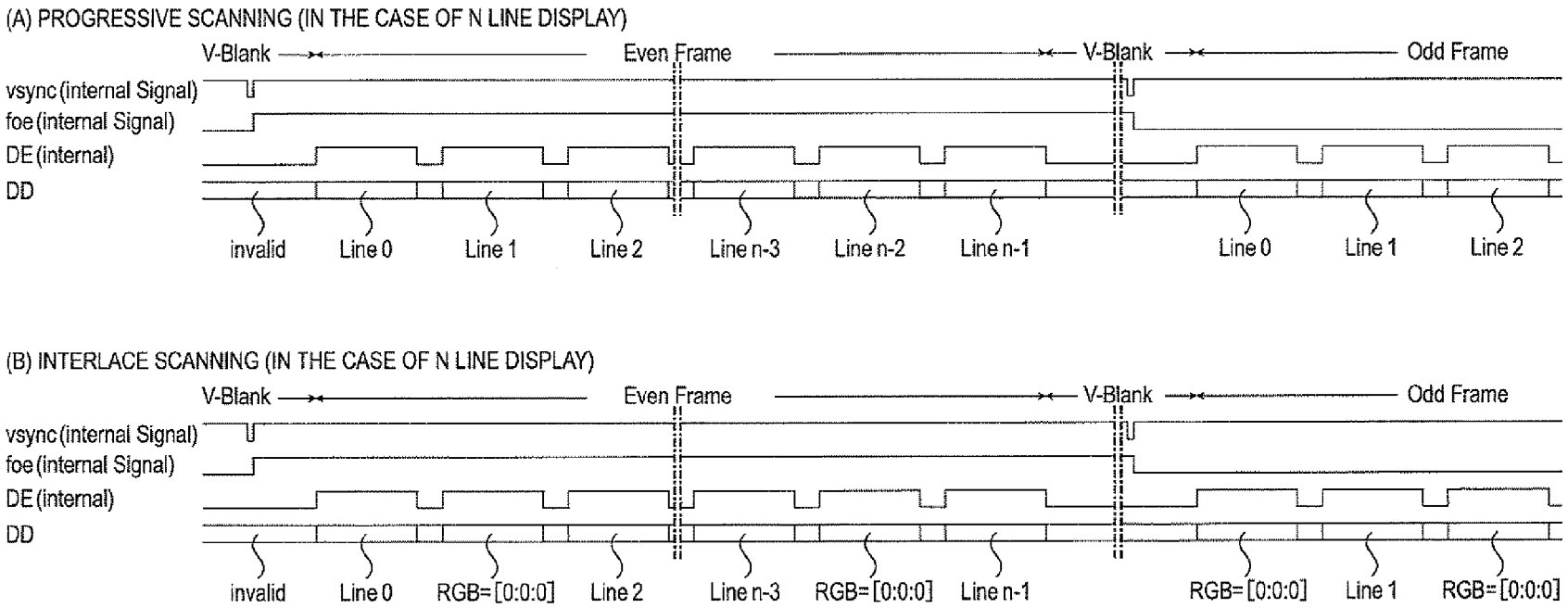
FIGS. 22(A) and 22(B) are timing diagrams of control examples in a second mode.

FIGS. 22(A) and 22(B) illustrate timing diagrams of control examples in a second mode. FIGS. 22(A) and 22(B) show an internal vertical synchronous signal vsync, an internal frame determination signal foe, an internal data enable signal DE and an image data DD to be output. In addition, FIG. 22(A) shows the timing of a control example during progressive scanning in displaying a screen formed from the number of lines n (n: an integer of 2 or more). FIG. 22(B) shows the timing of a control example during interlace scanning in the second mode in displaying the screen formed from the number of lines n.

For example, when a period at which a data enable signal DE is at an L level is longer than a predetermined period of time, the display timing generation circuit 190 detects the period as a vertical blanking period, and generates an internal vertical synchronous signal vsync. A frame determination signal foe is a signal of reversing for each vertical synchronous signal vsync and showing whether an frame is an odd frame or an even frame.

In the second mode, during progressive scanning, respective lines of images are displayed regardless of whether a frame is of an odd or even number. On the contrary, when switched to interlace scanning, a frame determination signal foe displays an even line when an even frame is shown and an odd line when an odd frame is shown. More specifically, when f=2xp and h=2xq are set, where p, q are integers, the second sticking prevention circuit for image 174 causes pixel values of R-component, G-component and B-component forming image data to generate a black line of "0" at (h+1) line of an f frame and to generate the same black line at an h line of (f+1) frame. Thus, as shown in FIG. 22(B), for example, when an even frame is shown, an even line is displayed, and when an odd frame is shown, an odd line is displayed for achieving interlace scanning.

The second sticking prevention circuit for image 174 outputs image data as usual during progressive scanning, and when switched to interlace scanning after the second interval time has elapsed, image data control is performed as described above.

<Third Mode>

Figure 23:
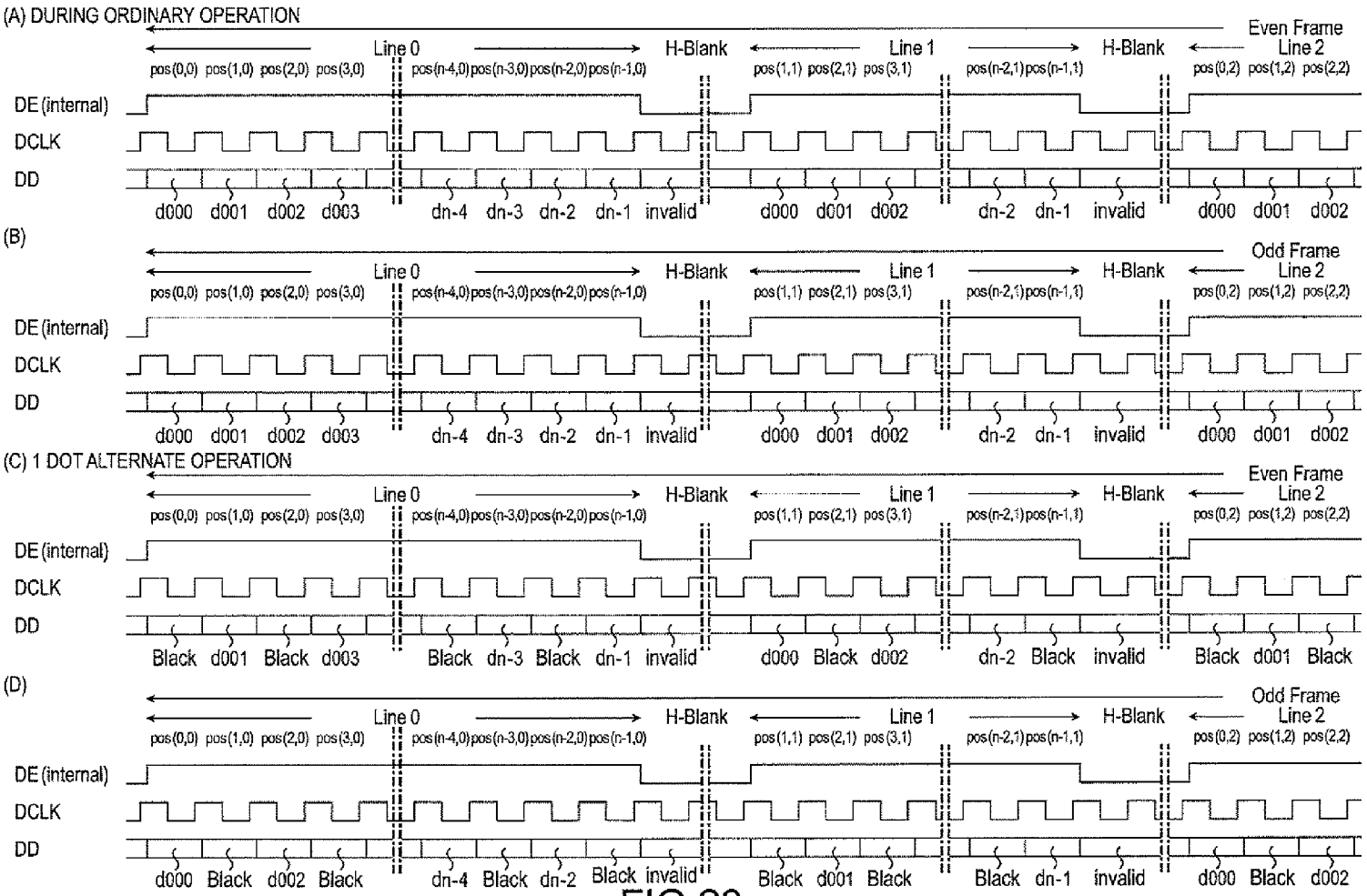
FIGS. 23(A), 23(B), 23(C) and 23(D) are timing diagrams of control examples in a third mode.

FIGS. 23(A), 23(B), 23(C) and 23(D) illustrate timing diagrams of control examples in a third mode. FIGS. 23(A), 23(B), 23(C) and 23(D) show an internal data enable signal DE, a dot clock DCLK and image data DD to be output. FIG. 23(A) shows a control example of an even frame during ordinary operation, FIG. 23(B) shows a control example of an odd frame during ordinary operation, FIG. 23(C) shows a control example of an even frame in performing control on alternate dots, and FIG. 23(D) shows a control example of an odd frame in performing control on alternate dots.

In the third mode, during ordinary operation, respective lines of images are displayed regardless of whether a frame is of an odd or even number. On the contrary, in performing control on alternate dots, when f=2xp, h=2xq and d=2xr are set, where p, q, r are integers, the third sticking prevention circuit for image 176 causes each of pixel values of R-component, G-component and B-component forming image data to generate image data of a black dot of "0" as image data of d dot at h line of an f frame, image data of a black dot as image data of (d+1) dot at an (h+1) line of an f frame, image data of a black dot as image data of (d+1) dot at an h line of an (f+1) frame, and to generate image data of a black dot as image data of d dot at an (h+1) line of an (f+1) frame, respectively. Thus, as shown in FIG. 23(C) and FIG. 23(D), for example, an even dot of an even line and an odd dot of an odd line can be displayed as black dots at an even frame, and an odd dot of an even line and an even dot of an odd line can be displayed as black dots at an odd frame.

The third sticking prevention circuit for image 176, during ordinary operation, is capable of repeating to output image data as usual and to output image data after the above control. In the third mode, distinction can be made between an even frame and an odd frame in the same way as in the second mode.

<Fourth Mode>

Figure 24:
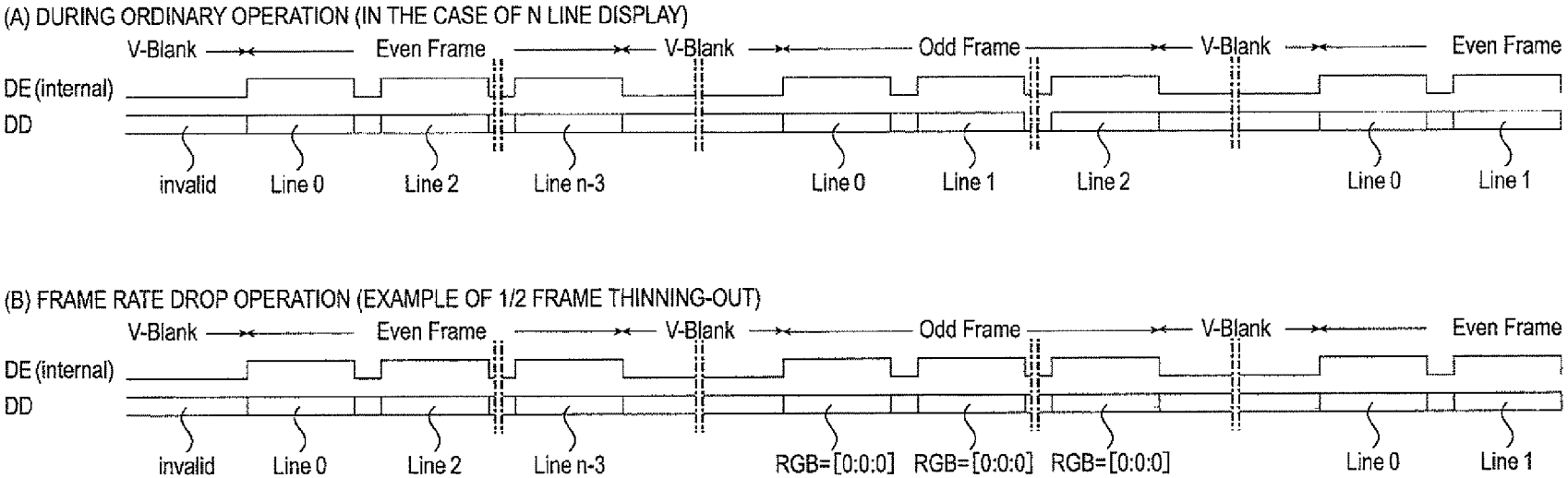
FIGS. 24(A) and 24(B) are timing diagrams of control examples in a fourth mode.

FIGS. 24(A) and 24(B) illustrate timing diagrams of control examples in a fourth mode. FIGS. 24(A) and 24(B) show an internal data enable signal DE and image data DD to be output. FIG. 24(A) shows the timing of a control example during ordinary operation in displaying a screen of the number of lines n (n: an integer of 2 or more) and FIG. 24(B) shows the timing of a control example in the third mode in displaying a screen of the number of lines n. Although FIG. 24(B) shows an example of ½ frame thinning-out, ⅔ frame may be displayed by ⅓ frame thinning-out, ¾ frame may be displayed by ¼ frame thinning-out, and ⅘ frame may be displayed by ⅕ frame thinning-out.

In the fourth mode, during ordinary operation, respective lines of images are displayed regardless of whether a frame is of an odd or even number. On the contrary, the fourth sticking prevention circuit for image 178 outputs image data at only an even frame with pixel values of original images left unchanged and generates and outputs image data of black images in which each of pixel values of R-component, G-component and B-component forming respective dots is "0" as image data of all dots of all images at only an odd frame. Thus, as shown in FIG. 24B), in an odd frame, a black image is displayed, and the frame rate substantially becomes a half. In the case of other frame thinning-out, it is sufficient to properly insert a black image into the thinned-out frame.

The fourth sticking prevention circuit for image 178, during ordinary operation, is capable of repeating to output image data as usual and to output image data after the above control.

As described above, the present embodiment can detect whether or not frames for which images to be displayed are still images are continuous (still image continuous detection step), and control and output image data corresponding to the still image or a display timing control signal corresponding to the image data so that each of pixels forming the image is displayed with different brightness at given intervals while it is being detected that the frames of still images are continuous (display control step). The present embodiment can detect whether or not frames for which images to be displayed are still images are continuous, and control and output image data corresponding to the still image or a display timing control signal corresponding to the image data so that each of pixels forming the image is displayed with different brightness at given intervals while it is being detected that the frames of still images are continuous. As a result, a so-called sticking phenomenon can be alleviated with low power consumption and high efficiency without causing degradation in the image quality of a display image of a display panel using an OLED.

The display system 10 according to the present embodiment can be applied to the following electronic apparatuses, for example.

Figure 25A:
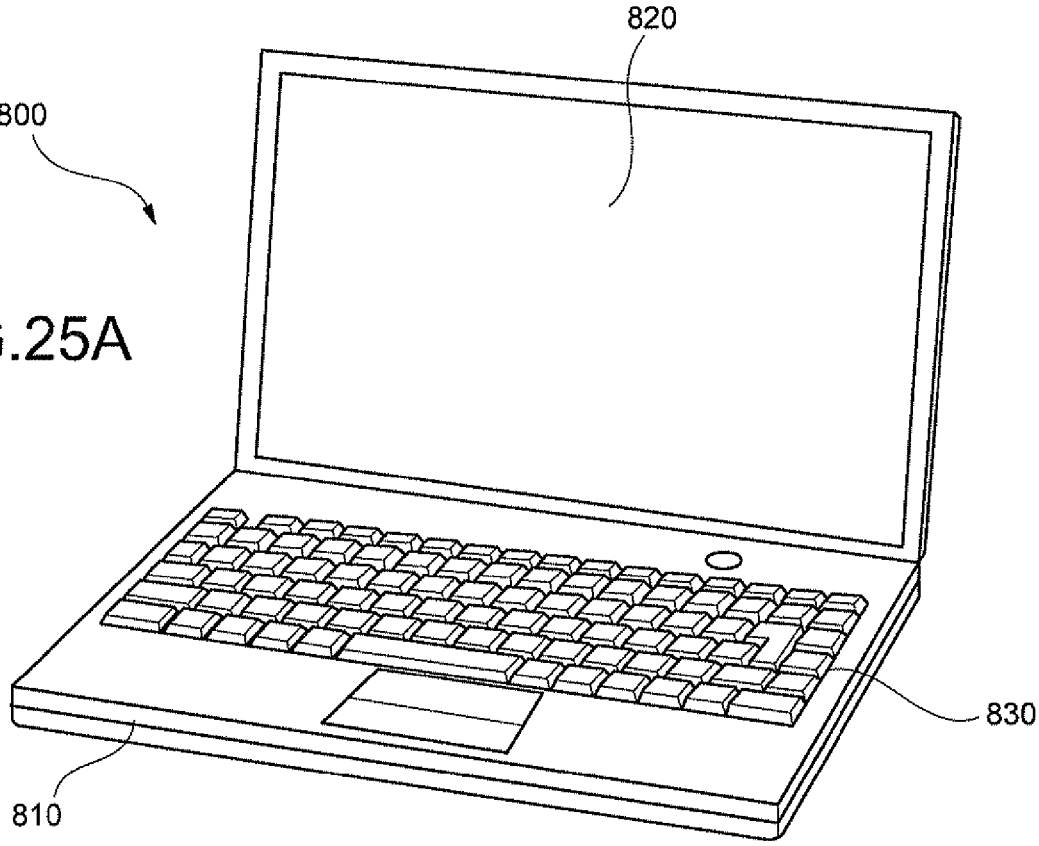
FIGS. 25(A) and 25(B) are perspective views illustrating a configuration of an electronic apparatus to which a display system according to the present embodiment is applied.
Figure 25B:
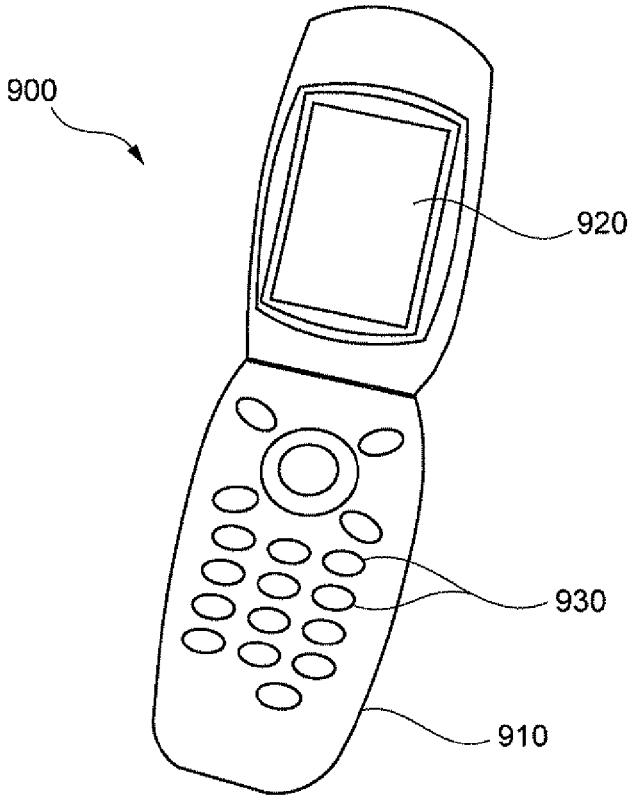

FIGS. 25(A) and 25(B) illustrate a perspective view illustrating a configuration of an electronic apparatus in which the display system 10 according to the present embodiment is applied. FIG. 25(A) shows a perspective view of a configuration of a mobile personal computer. FIG. 25(B) shows a perspective view of a configuration of a mobile phone.

A personal computer 800 shown in FIG. 25(A) includes a main body 810 and a display part 820. As the display part 820, the display system 10 according to the present embodiment is mounted. The main body 810 includes the host 60 of the display system 10, and the main body 810 is provided with a keyboard 830. That is to say, the personal computer 800 includes at least the timing controller 50 according to the present embodiment. The operational information through the keyboard 830 is analyzed by the host 60 and an image is displayed on the display part 820 according to the operational information. The display 820, using an OLED as a display element, provides the personal computer 800 equipped with a screen having a wide viewing angle.

A mobile phone 900 shown in FIG. 25(B) includes a main body 910 and a display part 920. As the display part 920, the display system 10 according to the present embodiment is mounted. The main body 910 includes the host 60 of the display system 10, and the main body 910 is provided with a keyboard 930. That is to say, the mobile phone 900 includes at least the timing controller 50 according to the present embodiment. The operational information through the keyboard 930 is analyzed by the host 60, and an image is displayed on the display part 920 according to the operational information. The display 920, using an OLED as a display element, provides the mobile phone 900 equipped with a screen having a wide viewing angle.

Electronic apparatuses to which the display system 10 according to the present embodiment is applied are not limited to those illustrated in FIGS. 25(A) and 25(B) and include PDAs (Personal Digital Assistants), digital still cameras, TV sets, video cameras, car navigation systems, pagers, computerized personal organizers, electronic paper, scientific calculators, word processors, workstations, picture phones, POS (Point of Sale System) terminals, printers, scanners, copying machines, video players and devices having a touch panel, for example.

Although an image processing apparatus, a display system, an electronic apparatus, a method of processing an image and the like according to the present invention have been described based on the above embodiment, the present invention is not limited to the above embodiment, and may be implemented in various aspects without departing from the spirit and scope thereof. For example, the following modifications may be considered.

(1) In the present embodiment, four types of examples have been described as sticking prevention control; however, the present invention is not limited to contents or types of sticking prevention control, and it is sufficient if a plurality of sticking prevention control can be concurrently performed.

(2) In the present embodiment, the display system to which an OLED having a configuration shown in any of FIGS. 1-3 is applied has been described as an example; however, the present invention is not limited thereto.

(3) The still image continuous detection circuit 110 according to the present embodiment is not limited to the configuration shown in FIG. 9. That is to say, the present embodiment is not limited to a method for detecting that still images are continuous.

(4) In the present embodiment, as sticking prevention control, a shift has been made by unit of one dot or one scanning line; however, the present invention is not limited thereto. A shift may be made by unit of one pixel, a plurality of dots or a plurality of scanning lines.

(5) In the present embodiment, the present invention has been described as an image processing apparatus, a display system, an electronic apparatus, a method of processing an image and the like; however, the present invention is not limited thereto. The present invention may include a program in which a processing procedure for the above image processing method has been described or a recording medium on which the program has been recorded, for example.

The invention claimed is:

1. An image processing apparatus that performs display control of an image displayed on a display unit, comprising:

a first control circuit to perform sticking prevention for controlling image data of a frame or a display timing control signal corresponding to the image data so as to display each pixel forming the image with different brightness at given intervals, a second control circuit to perform sticking prevention for controlling the image data or the display timing control signal by different control from that by the first control circuit so as to display each pixel forming the image with different brightness at given intervals, an interval register set with control data corresponding to an interval time between first control start timing by the first control circuit and second control start timing by the second control circuit, after the control of the image data or the display timing control signal is started by the first control circuit, and the interval time set in the interval register has elapsed, the first control circuit and the second control circuit control image data of an identical frame or a display timing control signal corresponding to the image data, the first control circuit and the second control circuit control image data of an identical frame or a display timing control signal corresponding to the image data by switching mode at predetermined intervals; wherein the first control circuit and the second control circuit control the image data or the display timing control signal so as to display each pixel forming the image with different brightness at given intervals in at least one mode among a first mode of shifting an original display image by an amount corresponding to one dot after a first interval time has elapsed, a second mode of switching between interlace scanning and progressive scanning each time a second interval time has elapsed, a third mode of lowering a frame rate for each dot and a fourth mode of thinning out an image display for each given frame, and wherein a first mode sequentially repeats, at every lapse of a given period of time, a first shift of shifting an original display image by an amount corresponding to one scanning line in a first vertical scanning direction of a screen of the display panel, a second shift of shifting the original display image by an amount corresponding to one dot in a first horizontal scanning direction of the screen of the display panel, a third shift of shifting the original display image by an amount corresponding to one scanning line in the opposite direction to the first vertical scanning direction of the screen of the display panel, and a fourth shift of shifting the original display image by an amount corresponding to one dot in the opposite direction to the first horizontal scanning direction of the screen of the display panel.

2. The image processing apparatus according to claim 1, comprising a still image continuous detection part for detecting whether or not frames for which images to be displayed are continuous still images, the first control circuit and the second control circuit start control of the image data or the display timing control signal, provided that the still image continuous detection part detects that frames of still images are continuous.

3. The image processing apparatus according to claim 2,wherein the still image continuous detection part detects whether or not frames of still images are continuous, based on a comparison result between a pixel value of each pixel forming an image of a frame in question and a pixel value of each pixel forming an image of an immediately preceding frame.

4. The image processing apparatus according to claim 3, comprising a detection condition designation register for designating a number of blocks matching between the frame in question and the immediately preceding frame in each of a plurality of blocks into which one screen is divided, the still image continuous detection part performs a comparison between a pixel value of each pixel forming an image of a frame in question and a pixel value of each pixel forming an image of an immediately preceding frame, for each block, and detects whether or not frames of still images are continuous, based on the number of blocks designated by the detection condition designation register.

5. The image processing apparatus according to claim 4, comprising a threshold setting register for designating the number of matching or mismatching pixels in the block, the still image continuous detection part determines that the block matches if the number of pixels matching in the block is equal to or more than the number of pixels set in the threshold setting register, or if the number of pixels mismatching in the block is equal to or less than the number of pixels set in the threshold setting register.

6. A display system comprising:

a display panel having a plurality of row signal lines, a plurality of column signal lines crossing the plurality of row signal lines, and a plurality of light emitting elements, which is identified by any of the plurality of row signal lines and any of the plurality of column signal lines, and emits light with brightness according to a driving current;

a row driver for driving the plurality of row signal lines;

a column driver for driving the plurality of column signal lines; and the image processing apparatus according to claim 1 for outputting the display control signal to the row driver and the column driver and outputting the image data to the column driver.

7. An electronic apparatus comprising the image processing apparatus according to claim 1.

8. A method of processing an image that performs display control of an image displayed on a display unit, comprising:

a first control step for performing sticking prevention of controlling image data of a frame or a display timing control signal based on the image data so as to display each pixel forming the image with different brightness at given intervals, a second control step for performing sticking prevention of controlling the image data or the display timing control signal by different control from that by the first control step so as to display each pixel forming the image with different brightness at given intervals, an interval setting step of setting an interval between first control start timing in the first control step and second control start timing in the second control step, after control of the image data or the display timing control signal is started in the first control step, and an interval set in the interval setting step has elapsed, the first control step and the second control step control image data of an identical frame or a display timing control signal based on the image data, the first control step and the second control step control image data of an identical frame or a display timing control signal based on the image data by switching mode at predetermined intervals; wherein the first control step and the second control step control the image data or the display timing control signal so as to display each pixel forming the image with different brightness at given intervals in at least one mode among a first mode of shifting an original display image by an amount corresponding to one dot after a first interval time has elapsed, a second mode of switching between interlace scanning and progressive scanning each time a second interval time has elapsed, a third mode of lowering a frame rate for each dot and a fourth mode of thinning out an image display for each given frame, and wherein a first mode sequentially repeats, at every lapse of a given period of time, a first shift of shifting an original display image by an amount corresponding to one scanning line in a first vertical scanning direction of a screen of the display panel, a second shift of shifting the original display image by an amount corresponding to one dot in a first horizontal scanning direction of the screen of the display panel, a third shift of shifting the original display image by an amount corresponding to one scanning line in the opposite direction to the first vertical scanning direction of the screen of the display panel, and a fourth shift of shifting the original display image by an amount corresponding to one dot in the opposite direction to the first horizontal scanning direction of the screen of the display panel.

9. The method of processing an image according to claim 8, comprising a still image continuous detection step of detecting whether or not frames for which images to be displayed are still images are continuous, the first control step and the second control step start control of the image data or the display timing control signal, provided that the still image continuous detection step detects that frames of still images are continuous.

10. The method of processing an image according to claim 9, wherein the detection condition designation step designates the number of matching or mismatching pixels in the block, and the still image continuous detection step determines that the block matches when the number of pixels matching in the block is equal to or more than the number of pixels matching in a block designated in the detection condition designation step, or when the number of pixels mismatching in the block is equal to or less than the number of pixels mismatching in a block designated in the detection condition designation step.

* * * * *